US009074401B2

(12) United States Patent
Jensen et al.

(10) Patent No.: US 9,074,401 B2
(45) Date of Patent: Jul. 7, 2015

(54) COVERINGS FOR BUILDING APERTURES OR SURFACE PORTIONS OF BUILDINGS AND DRIVE SYSTEM FOR SUCH COVERINGS

(75) Inventors: Jørn Krab Jensen, Frederiksberg C (DK); Jakob Dydensborg, Borre (DK); Svend-Erik Paulsen Dahl, Hedehusene (DK)

(73) Assignee: Jørn Krab Holding ApS, Copenhagen V (DK)

( * ) Notice: Subject to any disclaimer, the term of this patent is extended or adjusted under 35 U.S.C. 154(b) by 0 days.

(21) Appl. No.: 14/127,515

(22) PCT Filed: Jun. 19, 2012

(86) PCT No.: PCT/EP2012/061669

§ 371 (c)(1),
(2), (4) Date: Feb. 10, 2014

(87) PCT Pub. No.: WO2012/175478

PCT Pub. Date: Dec. 27, 2012

(65) Prior Publication Data

US 2014/0223826 A1 Aug. 14, 2014

(30) Foreign Application Priority Data

Jun. 20, 2011 (EP) ..... 11170572

(51) Int. Cl.
*E05F 11/34* (2006.01)
*E05F 15/14* (2006.01)
(Continued)

(52) U.S. Cl.
CPC ..... *E05F 15/148* (2013.01); *E06B 3/46* (2013.01); *E06B 7/02* (2013.01); *E06B 7/2309* (2013.01);
(Continued)

(58) Field of Classification Search
CPC ..... E05F 15/148; E05F 15/652; E06B 7/02; E06B 7/2309; E06B 9/04; E06B 3/46
USPC ..... 49/360, 362; 296/185.1, 216.01, 222, 296/216.04, 223, 220.01
See application file for complete search history.

(56) References Cited

U.S. PATENT DOCUMENTS 1,858,624 A * 5/1932 Hess et al. ..... 74/625
1,863,923 A * 6/1932 Diggins ..... 49/117
(Continued)

FOREIGN PATENT DOCUMENTS

DE 4428983 A1 2/1996
DE 200 21 691 U1 4/2001
(Continued)

OTHER PUBLICATIONS

International Search Report and Written Opinion, dated May 23, 2013 for PCT/EP2012/061669.
(Continued)

*Primary Examiner* — Jerry Redman
(74) *Attorney, Agent, or Firm* — Peter A. Nieves; Sheehan Phinney Bass + Green PA

(57) ABSTRACT

The invention relates to a mechanism for converting a rotary motion originating from a rotary energy generator (1) into a longitudinal motion of a carriage (25) that is adapted for attachment to a covering, such that said rotary motion will result in a longitudinal displacement of the covering, the mechanism comprising one or more spindle sections (2, 3, 4, 5) drivingly connected at a longitudinal end of at least one of said spindle sections via a gear means (7; 9; 22, 23, 24, 27) to said rotary energy generator (1). The invention further relates to a drive system for coverings comprising mechanisms according to the invention. The invention further relates to a covering system for covering a surface portion such as a window, glass door or the like, of a building.

17 Claims, 17 Drawing Sheets

(51) Int. Cl.

| | |
|---|---|
| ***E06B 3/46*** | (2006.01) |
| ***E06B 7/02*** | (2006.01) |
| ***E06B 7/23*** | (2006.01) |
| ***E06B 9/04*** | (2006.01) |
| ***E05F 15/652*** | (2015.01) |

(52) U.S. Cl.

CPC ..... *E06B 9/04* (2013.01); *E05F 15/652* (2015.01); *Y10T 74/18576* (2015.01); *E06B 2007/023* (2013.01); *E06B 2007/026* (2013.01); *E05Y 2900/146* (2013.01)

(56) References Cited

U.S. PATENT DOCUMENTS

| | | | | | |
|---|---|---|---|---|---|
| 2,985,483 | A | * | 5/1961 | Golde et al. | 296/223 |
| 3,330,071 | A | * | 7/1967 | Kubisiak | 49/362 |
| 3,774,665 | A | | 11/1973 | Bourne | |
| 4,626,027 | A | * | 12/1986 | Farmont | 296/223 |
| 4,698,938 | A | * | 10/1987 | Huber | 49/138 |
| 5,069,502 | A | * | 12/1991 | Sekine et al. | 296/223 |
| 5,605,013 | A | * | 2/1997 | Hogston | 49/31 |
| 6,024,156 | A | | 2/2000 | Chu | |
| 7,410,201 | B1 | * | 8/2008 | Wilson et al. | 296/146.16 |
| 7,828,041 | B2 | * | 11/2010 | Schlecht | 160/370.22 |
| 7,895,964 | B2 | * | 3/2011 | Russikoff | 114/361 |
| 8,661,733 | B2 | * | 3/2014 | Lee | 49/118 |
| 8,690,235 | B2 | * | 4/2014 | Lee et al. | 296/214 |
| 8,807,644 | B2 | * | 8/2014 | Gruss et al. | 296/223 |
| 2002/0092236 | A1 | * | 7/2002 | Heffner et al. | 49/324 |
| 2011/0187162 | A1 | * | 8/2011 | Katayama et al. | 296/223 |
| 2013/0082489 | A1 | * | 4/2013 | Gruss et al. | 296/223 |

FOREIGN PATENT DOCUMENTS

| | | | |
|---|---|---|---|
| DE | 202004005204 | U1 | 6/2004 |
| GB | 2396657 | A | 6/2004 |
| WO | 91/04390 | A1 | 4/1991 |

OTHER PUBLICATIONS

International Preliminary Report on Patentability, dated Oct. 4, 2013, for PCT/EP2012/061669.

* cited by examiner

COVERINGS FOR BUILDING APERTURES OR SURFACE PORTIONS OF BUILDINGS AND DRIVE SYSTEM FOR SUCH COVERINGS

FIELD OF THE INVENTION

The present invention relates generally to coverings for a surface portion of buildings, such as for windows. More specifically, according to one aspect, the invention relates to a drive system for such coverings that can be adapted to varying needs for instance related to varying physical characteristics of coverings or to varying modes of displacements of coverings relative to a building surface. The invention furthermore relates to coverings for building apertures that are provided with means for co-operation with the mechanisms and systems of the invention. According to further aspects, the invention relates to further improvements of coverings for surface portion of buildings, such as windows or glass doors or other forms of closable apertures of buildings.

BACKGROUND OF THE INVENTION

Coverings for surface portions of buildings, such as for windows or similar closed apertures or transparent surface portions of buildings, that can be displaced between a position where the covering covers the surface portion and a position where the surface portion is either partially or fully uncovered are known within the art. The coverings are in practice positioned on a suitable drive and guide system that allows the desired displacement of the covering and that is provided with drive means for effecting this displacement. The drive and guide system must necessarily be placed outside on the surface of a building and be driven by suitable means such as one or more electric motors. Such motors are typically located in the drive and guide system, i.e. outside the building and this can cause problems in practice, for instance when a motor has to be dismantled for repair or replacement.

Furthermore, known drive and guide systems displace the covering by drive means acting at a single point or at a single edge portion of a covering, for instance acting on the upper edge portion of a rectangular or quadratic covering. If the covering has sufficient rigidity this means of displacement of the covering may be satisfactory, but for a more light-weight and less rigid covering it may prove necessary to drive the covering at more than one locations for instance on the upper and lower edge portions of the covering.

There is hence a need for a drive mechanism and drive system for coverings that allow high flexibility as regards placement of the motor, e.g. by providing a drive and guide system placed outside a building to be driven by one or more motors inside the building and for a mechanism and system that allows driving of the covering at more points or portions of the covering simultaneously, even by means of a single drive motor.

DISCLOSURE OF THE INVENTION

On this background it is an object of at least some embodiments of the invention to provide drive mechanisms and systems that allow externally located guide and drive systems for coverings to be driven by one or more motors that may e.g. be placed inside a building It is a further object of at least some embodiments of the invention to provide drive mechanisms and systems that facilitate driving the covering at more than a single point or portion of the covering, preferably, although not necessarily, by a single drive motor.

It is a further object of at least some embodiments of the present invention to provide drive mechanisms and systems that offer a high degree of freedom in design and implementation, e.g. horizontally or vertically.

It is a specific object of at least some embodiments of the invention to provide a drive system that can be adapted to varying needs for instance related to varying physical characteristics of coverings or to varying modes of displacements of coverings relative to a building surface.

It is a further object of at least some embodiments of the invention to provide a covering that facilitates the saving of energy.

It is a further object of at least some embodiments of the invention to provide a covering that provides adequate protection against one or more environmental factors such as rain, heat, cold, sunlight, and/or the like.

At least some of these and other objects and advantages are achieved by a drive mechanism according to the invention and a corresponding system comprising one or more such drive mechanisms according to the present invention.

According to a first aspect, the present invention thus relates to a mechanism for converting a rotary motion originating from a rotary energy generator, such as an electric motor, into a longitudinal motion of a carriage that is adapted for attachment to a covering, such that said rotary motion will result in a longitudinal displacement of the covering, the mechanism comprising one or more spindle sections drivingly connected to said rotary energy generator at a longitudinal end of at least one of said spindle sections, e.g. via a gear means.

According to an embodiment of the mechanism of the invention mechanism comprises a gear means for drivingly connecting one or more spindle sections to the rotary energy generator. In some embodiments, the gear means is an angular gear means converting a rotational movement of a drive shaft having a first longitudinal axis X1 into a rotational movement of a second shaft having a second longitudinal axis X2, where the axis X1 and X2 form an angle between each other.

The angle may be any angle larger than 0° and smaller than 180°. According to a specific embodiment said angle is substantially 90 degrees.

According to an embodiment of the invention the carriage is guided for longitudinal movement along said one or more spindle sections, the carriage being provided with engagement members formed for engagement with the threads of the spindle sections, such that a rotation of the spindle sections will result in a longitudinal displacement of the carriage along the spindle sections.

According to an embodiment of the invention the gear means comprises a housing accommodating a first gear wheel for connection to a drive axle of said rotary energy generator (for instance an electric motor) and a second gear wheel in engagement with the first gear wheel, the second gear wheel being adapted for connection to a longitudinal end of a spindle section.

According some embodiments, the gear means is enclosed within a housing, where the housing is provided with a track through which the engagement members can pass in the longitudinal direction of the spindle, thereby making it possible for the carriage to pass the housing of the gear mechanism.

According to a second aspect the present invention relates to a drive system for coverings for a surface portion of a building, in particular an exterior surface portion. The system may comprise a mechanism as described above.

The coverings may be in the form of panels, shutters or similar, generally flat, planar structures that are slidably arranged on a surface of a building, in particular an exterior surface of a building. The coverings may be arranged to be placed in front of a closable aperture such as a glass door or a window, for example, for the purpose of shading the aperture from the sun or for providing other protection. The surface portion to be covered may thus be a window, a glass door or another transparent surface portion of the building. Generally, such coverings define an enclosed space between the surface portion and the covering. When not in use, the covering may slide to a position away from the aperture. The covering may comprise a slidable frame defining an aperture, and one or more cover members attached to at least a portion of the frame for covering the aperture defined by the frame. Examples of cover members include plates or panes, sheets of textile or another suitable material, slats, etc. For example, the aperture defined by the frame may be chosen to correspond in shape in size to the aperture of the building to be covered. The aperture defined by the frame may be rectangular or have a different shape. The slidable frame may comprise two vertical side frame members defining lateral edges of the covering, and two horizontal frame members defining upper and lower edges of the frame. Each frame member is an elongated member, e.g. formed as an extruded profile. A first carriage may be attached to a first frame member of the frame, e.g. the upper horizontal frame member, and a second carriage may be attached to a second frame member of the frame, e.g. a lower horizontal frame member, opposite the first frame member such that the carriages may engage respective parallel spindles that are spaced apart from each other in the transverse direction, thus allowing the spindles to be arranged on respective sides of an aperture of a building.

Hence, the first and second drive spindles may be arranged parallel with each other and displaced from each other in the transverse direction by a distance corresponding to (e.g. substantially equal to) the size of the frame defined between the first and second frame members.

According to an embodiment of the invention the system only comprises a first drive spindle for displacing a covering over a surface portion of for instance a wall or a window aperture, the covering comprising a frame. This first drive spindle is driven as set out above and arranged for converting a rotary motion into a longitudinal motion of a carriage attached to a first frame member, e.g. an upper frame member, of the frame. A second frame member opposite the first frame member relative to the aperture defined by the frame may run in a suitable guide track to guide its displacement over the surface portion. It is, however, also possible to drive a covering at two opposite frame members, e.g. at an upper frame member and at a lower frame member, which may be advantageous, if the covering has not sufficient rigidity to ensure stable displacement of the covering over the given surface portion. In this case the first and second drive spindles may be driven by a single motor in operative connection with either the first or second drive spindle or, as set out below, the first and second drive spindles may be drivingly interconnected by an interconnecting drive shaft that may be driven by a motor, for instance via a suitable gear member. The drive shaft may be connected to the first and second spindle, e.g. to longitudinal ends of the respective drive spindles, via suitable gear mechanisms. Hence, both drive spindles may be driven in synchronism by a single motor. It will be appreciated that the drive spindles define the direction of longitudinal movement of the covering. The drive spindles may be arranged parallel to the plane defined by the frame.

According to an embodiment of the invention the system only comprises an upper drive spindle for displacing a covering over a surface portion of for instance a wall or a window aperture. This upper drive spindle is driven as set out above. The lower edge of a covering may run in a suitable guide track to guide its displacement over the surface portion. It is, however, also possible to drive a covering both at the upper edge portion hereof and at the lower edge portion hereof, which may be advantageous, if the covering has not sufficient rigidity to ensure stable displacement of the covering over the given surface portion. In this case the upper and lower drive spindles may be driven by a single motor in operative connection with either the upper or lower drive spindle or, as set out below, the upper and lower drive spindles may be drivingly interconnected by a drive shaft that may be driven by a motor, for instance via a suitable gear member.

According to an embodiment of the invention the system comprises an upper drive spindle comprising one or more spindle sections, and a lower drive spindle comprising one or more spindle sections, where the upper and lower drive spindles are drivingly connected via an interconnecting drive shaft connected to corresponding longitudinal ends of said upper and lower drive spindles via an angular gear mechanism.

According to an embodiment of the invention the rotary energy generator is drivingly connected to the upper drive spindle.

According to another embodiment of the invention the rotary energy generator is drivingly connected to the lower drive spindle.

According to still another embodiment of the invention the rotary energy generator is drivingly connected to the interconnecting drive shaft.

According to a specific embodiment the invention relates to a system comprising a guide track member for insertion between a surface portion of a building, or a window, and a covering, the guide track member being provided with a spindle track for accommodating the drive spindle and an adjacent guide track for accommodating and guiding the carriage, wherein the guide track member is attached to said surface portion and the covering is attached to said carriage that is displaceable accommodated in the adjacent track. The guide track member may be a frame member of a support frame attached to a surface portion of a building e.g. to a window frame or another exterior surface of a building.

According to a further aspect, disclosed herein are embodiments of a system for covering a surface portion of a building, the system comprising a covering for covering a surface portion of a building, and a support frame for attachment to a surface portion of a building, wherein the covering comprises a slidable frame, the frame comprising a carriage adapted for longitudinal movement along a guide track; wherein the support frame comprises a guide track member provided with a guide track (32) for accommodating the carriage; wherein the support frame comprises a sealing member for sealing an interface between the support frame and the frame of the covering when the covering is positioned in a position in front of the support frame.

In some embodiments, the system thus comprises a support frame for attachment to a surface portion of a building, e.g. to a window frame or along or surrounding the periphery of a window, between the surface portion and a covering, e g along a periphery of an aperture or transparent portion of the surface of the building. The support frame may comprise a sealing member on a surface of the support frame facing the covering.

The sealing may e.g. be a brush seal or a rubber seal extending along the frame portion. To this end, the support frame may comprise a receiving channel extending along at least a portion of the support frame.

The sealing member may be a strip gasket, a strip brush, or another form of strip seal having an attachment part and a sealing part, where the attachment part is configured to be inserted in the receiving channel. Hence, the space defined between the covering and the surface portion to be covered and surrounded by the support frame and the slidable frame may be sealed against humidity and temperature differences, thus contributing to an improved insulation of the building.

The sealing part may form a lip or blade-like portion or a hollow sealing bag. In some embodiments the sealing part may comprise folding lines that extend in the longitudinal direction of the strip. The folding lines are adapted facilitate collapsing or folding of the sealing portion when the covering is moved in front of the sealing member and exerts pressure on the sealing member.

The attachment part may be formed with a resilient snap-on member that engages an interior wall of the receiving channel or with a barbed periphery that frictionally engages the interior wall of the mounting channel for positionally fixing the seal member relative to the support frame.

In some embodiments, the support frame may have the same shape and size as the slidable frame of the covering, e.g. rectangular or in the form of a polygon with at least two parallel sides. The support frame may be formed by frame members in the same fashion as the slidable frame. A first frame member and a second frame member, e.g. two parallel side frame members or two parallel horizontal frame members, of the support frame may be formed as and function as guide track members provided with respective guide tracks for a carriage that is attached to the slidable frame, e.g. to corresponding first and second edge portions of the slidable frame. This allows the slidable frame to slide into position covering the support frame, along a direction defined by the first and second frame members of the support frame. To this end, the frame members forming the guide track members may longitudinal extend beyond the frame away from the surface portion to be covered, so as to allow the slidable frame to slide into a position where it does not cover or only partially covers the support frame. As described above, one or both guide track members may comprise a spindle track accommodating a drive spindle for longitudinal moving the corresponding carriage.

In some embodiments one or more of the further frame members of the support frame, different from the first and second frame members, may comprise a drive track for accommodating a drive shaft operationally connected to a motor and to one or both drive spindles, as described herein.

Accordingly, in some embodiments the frame members forming the support frame are each formed as a guide track member, e.g. made from a suitable weather-resistant extrudable material. The frame members of the frame may comprise two tracks, a first track shaped and sized to accommodate a drive spindle or a drive shaft, and a second track shaped and sized to accommodate a carriage of the slidable frame, or to receive an attachment part of a seal member. To this end, the second track is provided with a longitudinally extending, lateral aperture or slit in the wall facing the slidable frame allowing at least a mounting part of the carriage to project out of the second track towards a slidable frame, or for receiving an attachment part of the sealing member. Furthermore, the first and second tracks may be separated by a dividing wall that has a longitudinally extending aperture or slit allowing engagement members of the carriage to project into the first track and to engage a drive spindle accommodated in the first track.

A weather protecting sealing between the slidable frame and the support frame may thus be provided at the sides of the support frame not engaged by a carriage of the slidable frame. To this end suitable seal members may be mounted e.g. in the second track. Sealing along the sides engaged by a carriage may be provided by the carriage and/or by additional seal members, e.g. a brush seal on the side of the slidable and/or the support frame facing the corresponding other frame.

If neither a carriage nor a seal member is required along one or more portions of the support frame, the lateral aperture or slit facing the slidable frame may be covered by a suitable strip of cover material that may have an attachment part to be received in the second track in a similar manner as the attachment part of a sealing member. The first track may further be shaped and sized so as to receive one or more gear mechanisms, e.g. angular gear mechanisms described herein. Accordingly, all sides of the support frame structure may be formed from the same type of frame members, e.g. frame members having the same profile.

The first and second tracks may be provided by a single rail or profile. Alternatively, the first and second tracks may be provided by separate rails or profiles that are connected to each other during installation of the drive system. In one embodiment, the first track may be formed by a first profile. The system may comprise bearing members as described in more detail below that are inserted into the first or spindle track so as to form lateral dividing walls. The bearing members may have coupling parts adapted to provide an interlocking connection with the interior circumference of the first track. The bearing members may further comprise coupling parts adapted to be connected with a second and a third profile that together form the second or guide track track. This embodiment provides a simple manufacturing process as the drive spindle and the bearing members may be assembled and connected to the second and third profiles before the thus assembled drive system is laterally inserted into the spindle track.

Embodiments of the drive spindle described herein are may be comprised of a plurality of spindle sections, which may be advantageous for instance during storage and transportation of the system and contributes to the modular nature of the system described herein that allows the assembly of different types of coverings from a relatively small number of components. In some embodiments, each spindle section may comprise coupling members at their respective longitudinal ends, e.g. adapted to engage in a mating connection with corresponding coupling members of other spindle sections of the drive spindle so as to connect two or more spindle sections in longitudinal extension from each other. Hence, different versions and sizes of the drive system may be manufactured from a single type of drive sections. The dive spindle may e.g. comprise a drive shaft surrounded by one or more tubular spindle sections adapted to rotate with the drive shaft. It is however understood that also drive spindles comprising only one single section are covered by the invention. The drive spindle, or alternatively given sections hereof, may be substantially rigid, but also flexible spindles could be used in the invention. Both types of spindles fall within the scope of the invention.

Although in the following detailed description the drive spindle(s) are shown extending horizontally, and in some embodiments the interconnecting shaft driving both drive spindles in common are shown extending vertically, the reverse could also be the case, and generally, the drive mechanisms and systems of the invention can have any orientation other than horizontal/vertical. Even more generally, the present invention may also be used for coverings that are not rectangular or quadratic. For instance application of the mechanism and system according to the invention for a parallelogram-shaped covering would be possible.

The dimensions and the design of the mechanism according to the invention can be such that they can form part of a window profile just as they can be mounted on an existing window or alternatively directly on a covering.

The drive motor, control system and battery (for instance a stand-alone unit with a solar collector/panel or other, alternative energy supply) can either be placed internally in the building or externally on the system or be an integral part of guide track system of the mechanism.

In some embodiments the drive system comprises one or more bearing members that may be distributed spaced apart from each other along the length of the drive spindle. The bearing members may fix the lateral position of the spindle within a spindle track, thus providing a smooth operation and reducing noise. For example the bearing members may be formed as laterally extending walls in the spindle track with an aperture for receiving the drive spindle. The bearing members may be provided at intervals corresponding to the length of the spindle sections, such that they are arranged at the positions where two spindle sections are connected to each other. In some embodiments the bearing members are formed as plates, e.g. made of plastic, that have an outer periphery matching the interior circumference of the spindle track and a central through hole through which the drive spindle may extend. The plates may e.g. be generally c-shaped allowing them to be snapped onto the drive spindle.

According to a further aspect, disclosed herein are embodiments of a system for covering a surface portion of a building, the system comprising a covering for covering a surface portion of a building, and a support frame for attachment to a surface portion of a building, wherein the covering comprises a slidable frame, the frame comprising a carriage adapted for longitudinal movement along a guide track; wherein the support frame comprises a guide track member provided with a guide track for guiding the carriage; wherein the covering comprises one or more ventilation channels connecting the side of the covering facing the surface of a building and the side facing away from the building.

Generally, a covering may be provided with one or more ventilation holes or channels providing a fluid path from the side of the covering facing the surface of a building and the side facing away from the building. This allows ventilation of the space between the covering and the surface of the building, e.g. a window, covered by the covering. The ventilation holes or channels may be provided in the cover material and/or in the slidable frame supporting the cover material. In some embodiments the ventilation channels are provided in the lower and/or upper frame members, thus allowing ventilation to be supported by convection of air being heated in the space between the covering and the surface of the building, e.g. by sunlight. This creates a chimney effect creating an upwardly directed stream of air. In some embodiments, the surface of the building covered by the covering may likewise comprise one or more ventilation apertures communicating between the interior of the building and the space between the outer surface of the building and the covering. Hence, a ventilation of the building may be provided even when the covering is closed.

In some embodiments, the covering comprises a small turbine arranged in the ventilation stream of ventilation air, e.g. the upwardly directed stream of air in the space between the covering and the surface of the building. The turbine may be adapted to convert energy of the air stream into electrical energy. The turbine may e.g. be located in the ventilation channel of the lower and/or upper frame member. Alternatively, electrically driven fans may be provided to increase the ventilation effect.

Specific and non-limiting embodiments of the various aspects are described in the detailed description of the present invention.

BRIEF DESCRIPTION OF THE DRAWINGS

The invention will be better understood by reading the following detailed description of non-limiting embodiments of the invention in conjunction with the figures, where.

DETAILED DESCRIPTION OF THE INVENTION

Figure 1A:
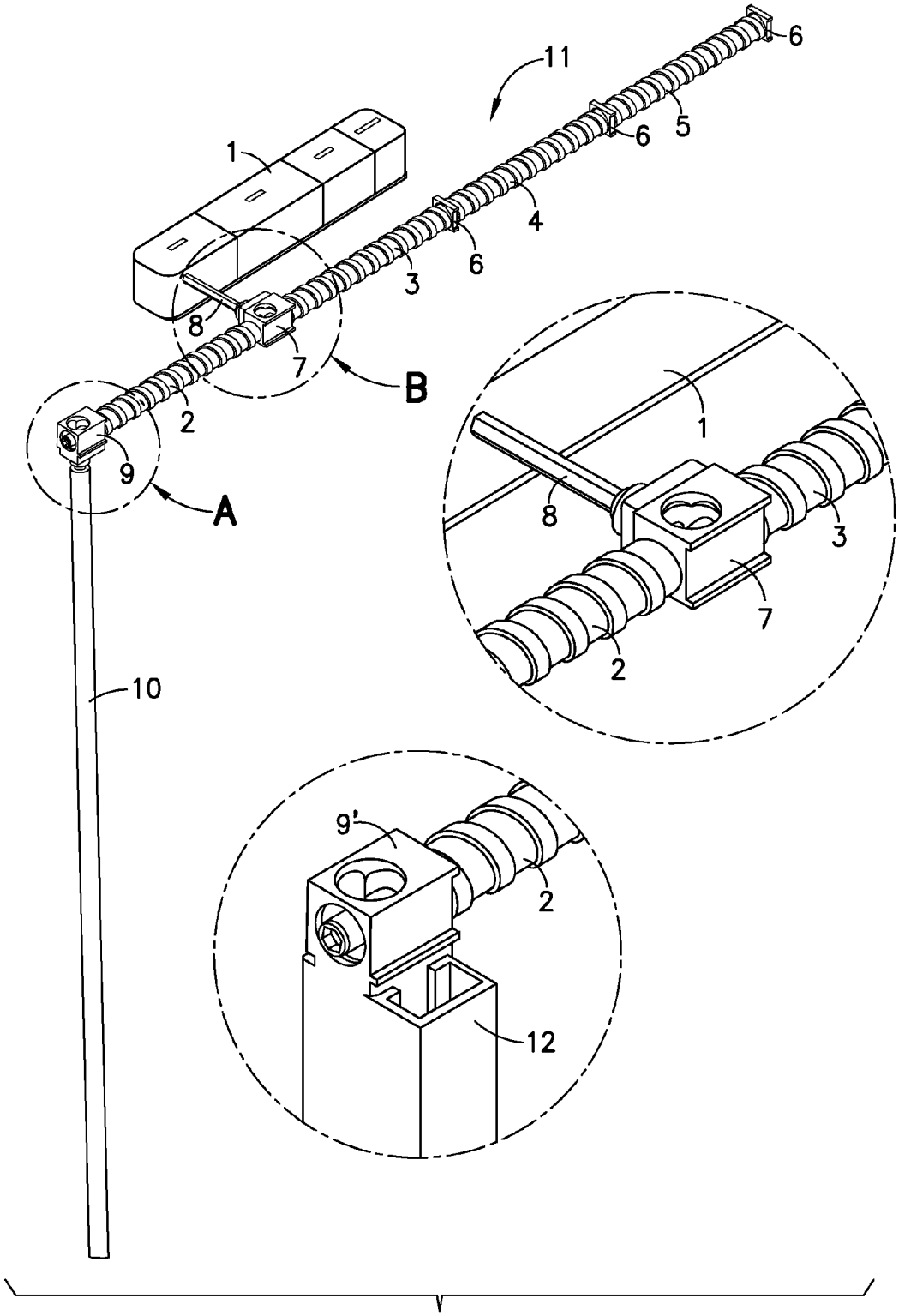
FIGS. 1(*a*) and (*b*) is a schematic representation of a drive system according to an embodiment of the invention showing upper and lower drive spindles laterally connected by a drive shaft and driven by a drive motor.
Figure 1B:
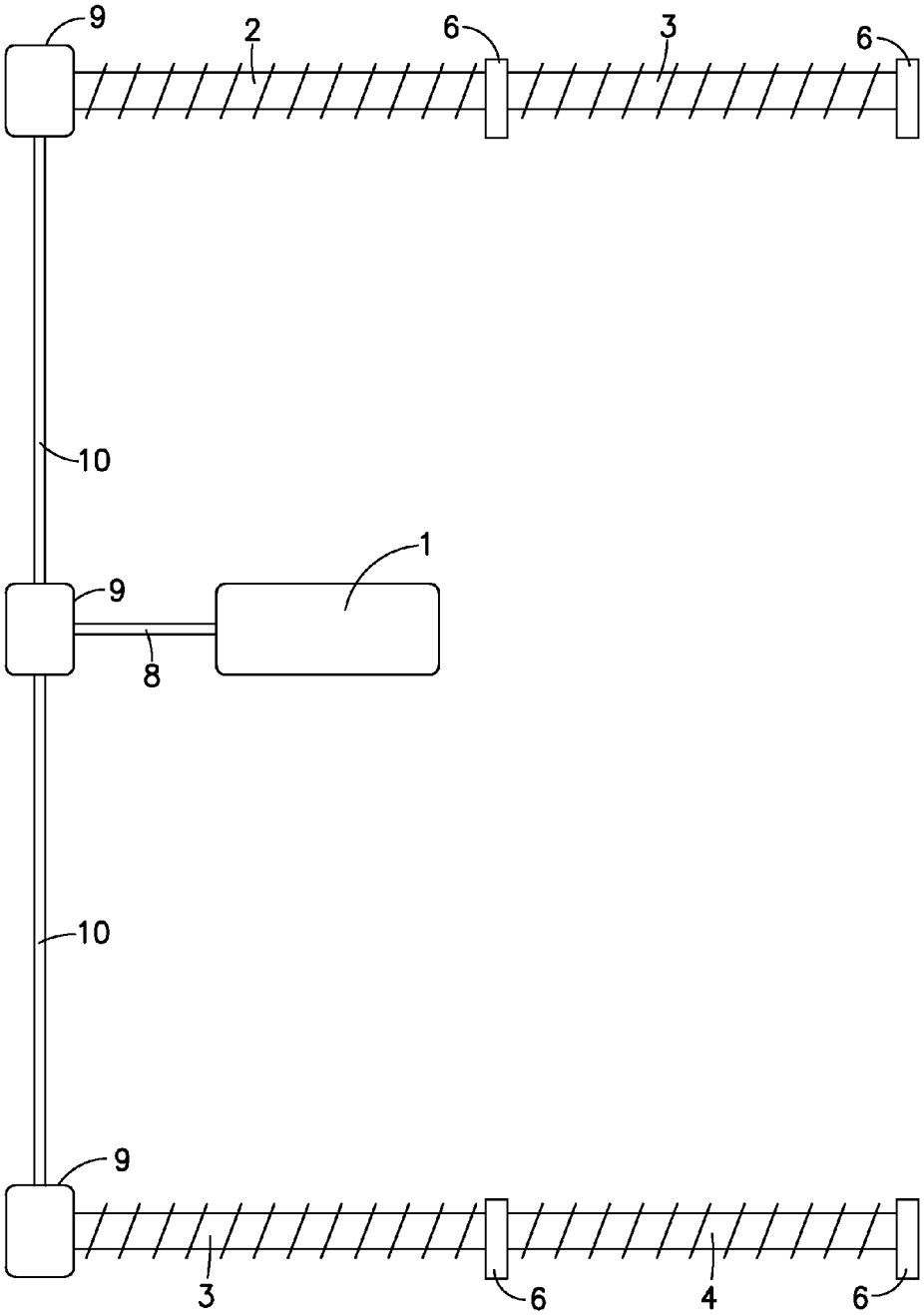

Referring to FIGS. 1(*a*) and (*b*) there is shown a schematic representation of a drive system according to embodiments of the invention showing upper and lower drive spindles 11, 12 laterally connected by an interconnecting drive shaft 10. In FIG. 1(*a*) the upper drive spindle 11 is driven by a drive motor 1 in engagement with the spindle via an angular gear mechanism 7 as will be explained in detail below. The upper spindle can be comprised of a number of spindle-sections 1, 3, 4, 5, but only a single such section may also be used according to the circumstances. In both of the embodiments shown in FIGS. 1(*a*) and 1(*b*) the upper drive spindle 11 is connected with a lower drive spindle 12 by means of a laterally located interconnecting drive shaft 10 connected at either longitudinal ends with the respective spindle sections via an angular gear mechanism 9. If more than one spindle section is used in the upper and/or lower drive spindle, these sections can be interconnected as explained below. The drive system according to the invention makes it possible to connect the drive means such as the motor 1 at a convenient place in the system, according to the specific circumstances, and the use of more than one drive motor is also possible by simple means according to the invention. In FIG. 1(*a*) the drive motor 1 is coupled to the drive system via the upper drive spindle 11 and in FIG. 1(*b*) the drive motor is alternatively coupled to the drive system via the connecting shaft 10 and via a suitable angular gear member 9 connecting the interconnecting shaft 10 to the drive shaft 8 of the motor. Longitudinally distributed along the drive spindles 11 and 12 may be positioned spindle bearings 6 that support the spindle and hence facilitates a smooth rotation of the spindle with reduced noise.

Referring to FIG. 1(*b*) it is noted that although the two lower spindle sections are shown schematically with spindles having the same pitch direction as the two upper spindle sections this requires that in the angular gear member 9 the drive axle 8 of the motor 1 drives the two respective connecting shafts 10 on either side of the gear via separate gear wheels. If a gear member 9 of the kind shown for instance in FIGS. 5(*b*) and 6 is used, opposite pitch directions of the upper and lower spindle sections must be used.

Figure 2:
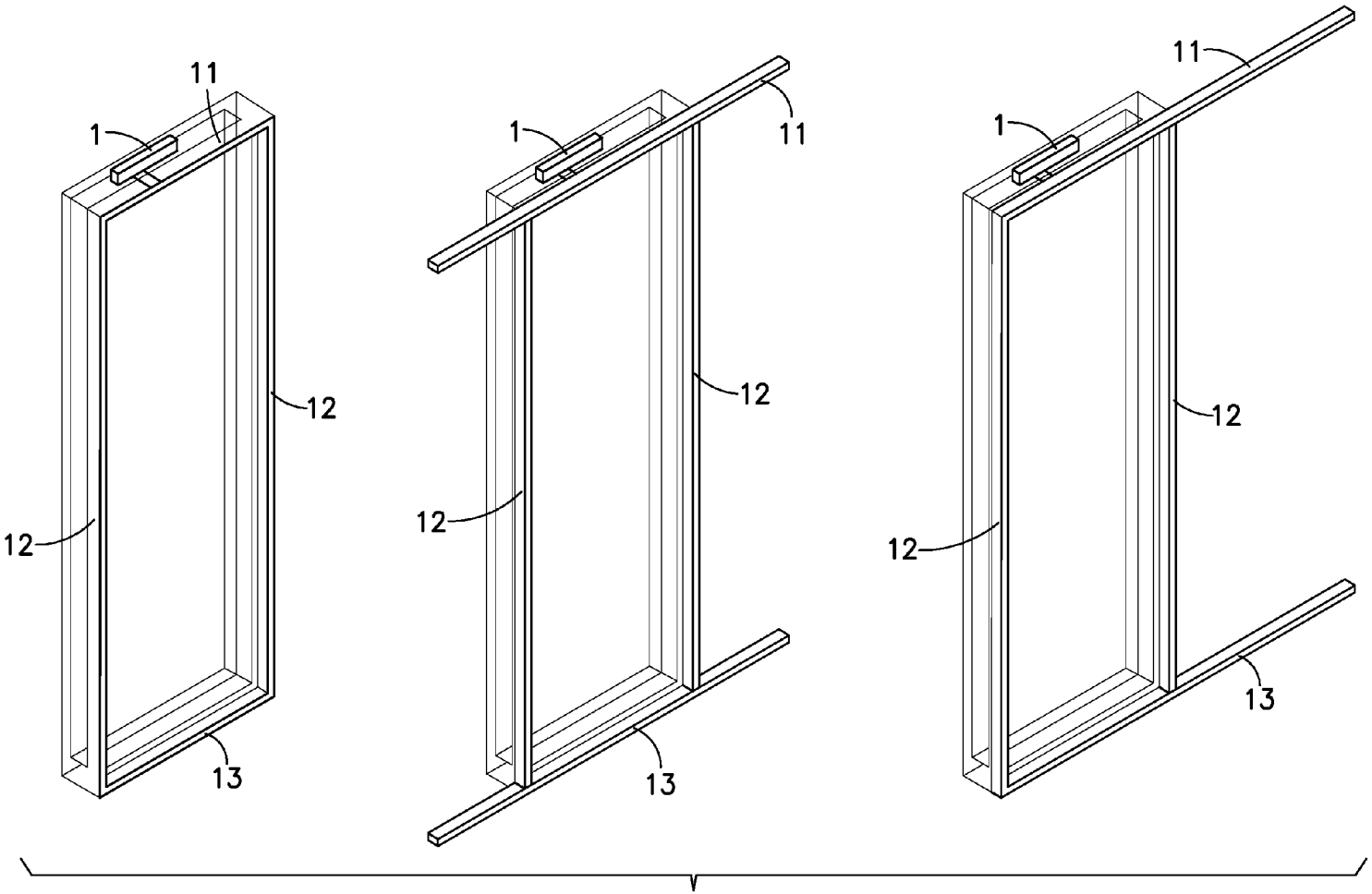
FIG. 2 is a schematic view of a first configuration of a drive system according to the invention with the drive motor placed adjacent the upper drive spindle and with a guide track for a covering at the bottom of the configuration.
Figure 3:
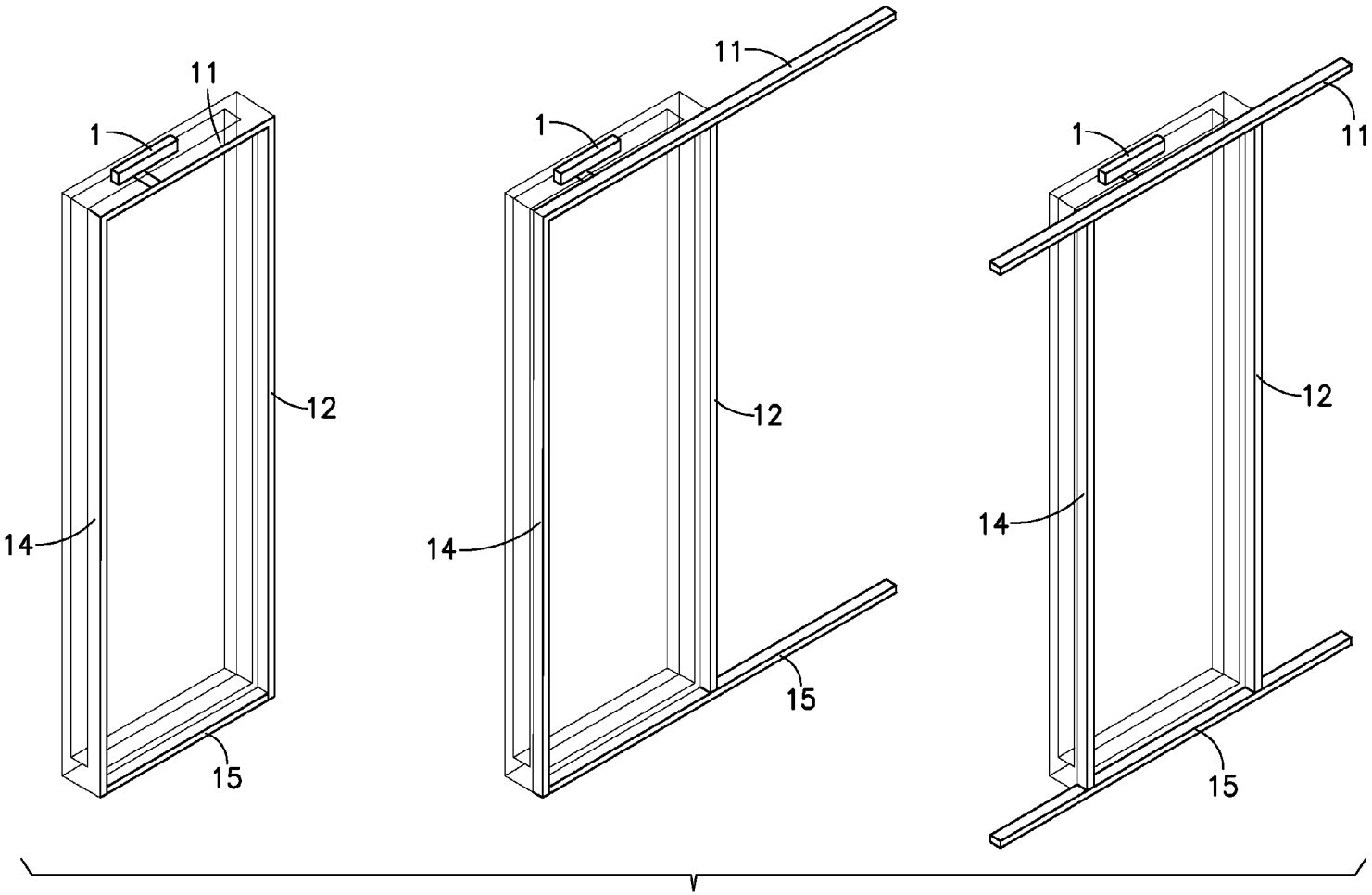
FIG. 3 is a schematic view of a second configuration of a drive system according to the invention with the drive motor placed adjacent the upper drive spindle and where the drive system is further provided with a lower drive spindle placed for engagement with the lower part of a covering, and where the upper and lower drive spindles are drivingly connected via a laterally placed vertical drive shaft.
Figure 4:
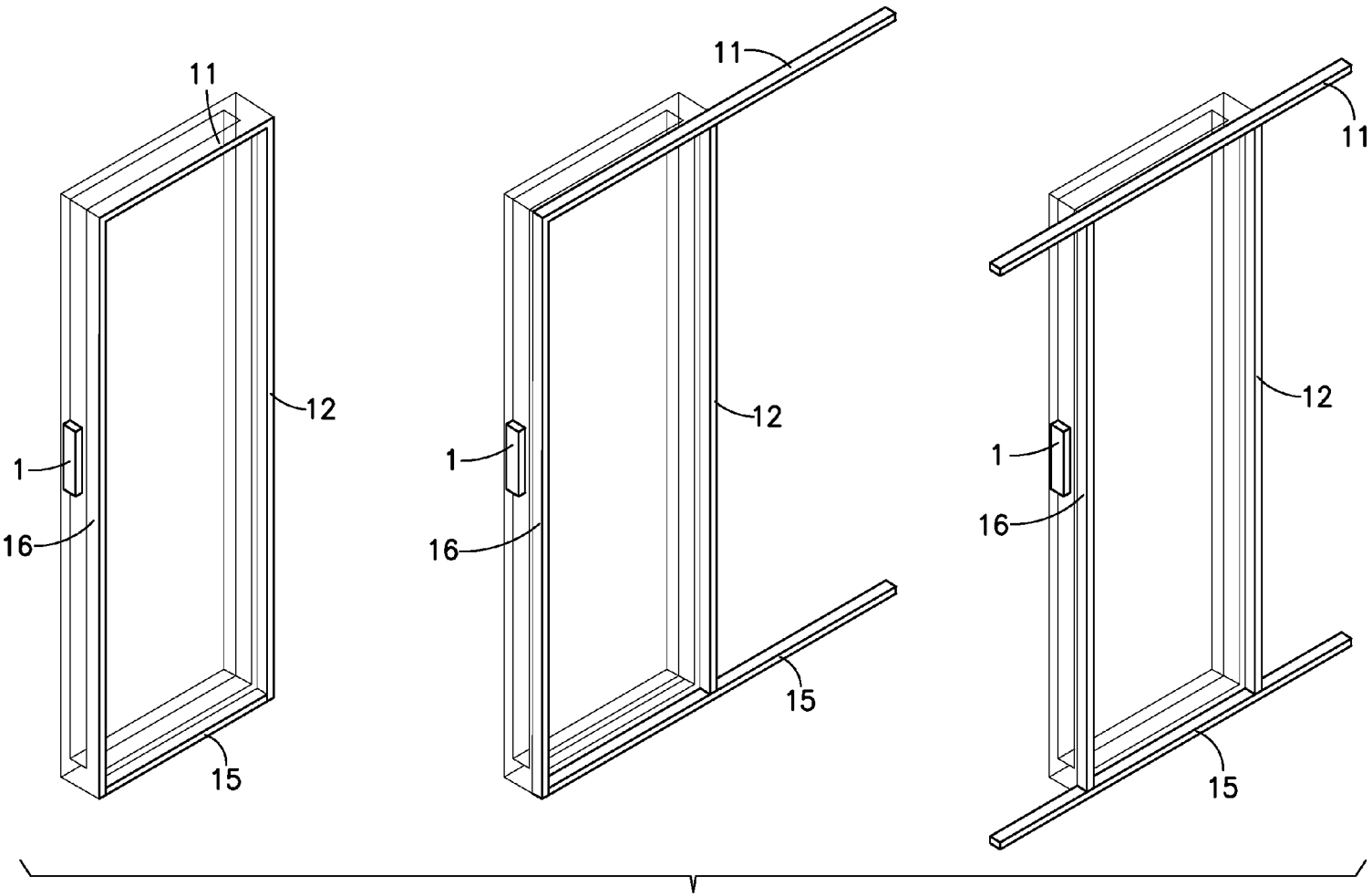
FIG. 4 is a schematic view of a third configuration of a drive system according to the invention with the drive motor placed adjacent the connecting laterally placed drive shaft that drivingly connects the upper and lower drive spindles.

As mentioned initially, the present invention facilitates the provision of drive systems of a number of alternative configurations, of which non-limiting examples are shown in FIGS. 2, 3 and 4. With reference to FIG. 2 there is thus shown a schematic view of a first configuration of a drive system according to the invention with the drive motor 1 placed adjacent the upper drive spindle 11 and with a guide track 13 for supporting and guiding a covering (not shown) at the bottom of the configuration.

With reference to FIG. 3 there is shown a schematic view of a second configuration of a drive system according to the invention with the drive motor 1 placed adjacent the upper drive spindle 11 and where the drive system is further provided with a lower drive spindle 15 placed for engagement with the lower part of a covering (not shown), and where the upper and lower drive spindles 11, 15 are drivingly connected via a laterally placed vertical interconnecting drive shaft 14.

With reference to FIG. 4 there is shown a schematic view of a third configuration of a drive system according to the invention with the drive motor 1 placed adjacent the connecting laterally placed drive shaft 16 that drivingly connects the upper and lower drive spindles 11, 15.

A further class of embodiments of the drive system according to the invention comprises laterally placed drive spindles at one or both lateral sides of the drive system and optionally connecting drive shafts connecting these spindles. As seen for instance in FIG. 4, this would correspond to the portions 12 and/or 16 being drive spindle portions and the portions 11 and/or 15 being connecting drive shafts. By these means a covering may be displaced vertically instead of horizontally, as is implicitly assumed in FIGS. 2, 3 and 4.

In the following a detailed description of embodiments of means for connecting a drive motor to the system and for providing driving engagement between the drive system and a covering is shown.

Figure 5A:
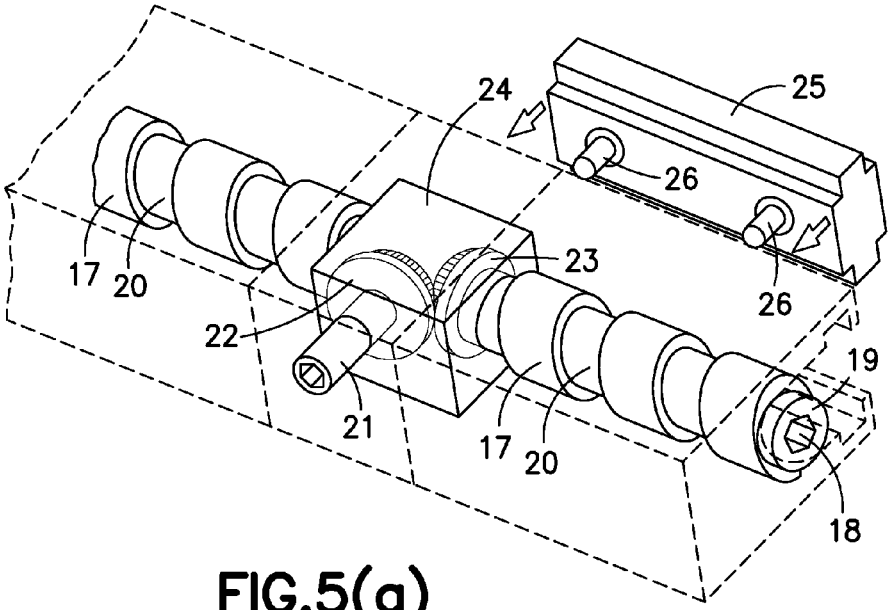
FIGS. 5(*a*) and (*b*) is a schematic perspective view of the driving connection between the spindle and the drive shaft via an angular gear coupling, wherein is further shown a schematic representation of carriage provided with engagement means for coupling the spindle to a covering.
Figure 5B:
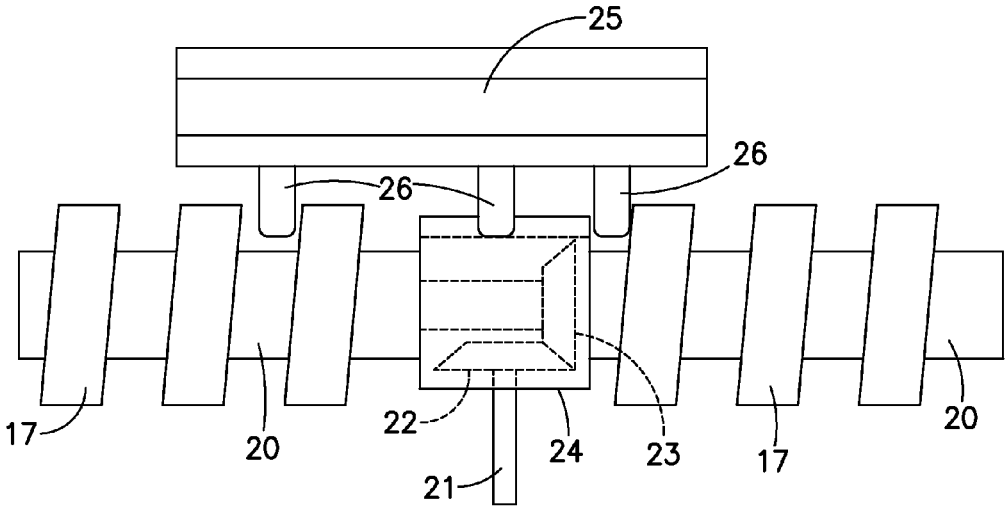

With reference to FIG. 5(*b*) there is shown a schematic perspective view of the driving connection between the spindle 17, 20 and the drive shaft 21 of a drive motor via an angular gear coupling. The angular gear coupling comprises a first gear wheel 22 operatively connected to the drive shaft 21 of the motor and in driving engagement with a second gear wheel 23 that is operatively connected to the corresponding spindle portion. The angular gear mechanism is housed within a housing 24 that may also serve as a bearing for the spindle. In the housing 24 there is provided a longitudinally extending track allowing the carriage 25 to become longitudinally displaced in the direction of the spindle and past the gear housing 24 of the gear mechanism. In FIG. 5 there is furthermore shown a schematic representation of a carriage 25 that is to be attached to a covering and which is provided with engagement means 26 for coupling the spindle to a covering. Preferably there are three such engagement means 26, whereby at least two engagement means 26 are always in engagement with the spindle. The distance between the engagement means 26 corresponds to the pitch of the spindle. Generally, at least two engagement means may be spaced apart in the longitudinal direction further than the longitudinal extent of the housing of the gear mechanism, thus ensuring that always at least one of the engagement members is engaged with the spindle.

In FIG. 5(*b*) there is shown the same embodiment of the driving connection as in FIG. 5(*a*), but viewed from above. The carriage 25 shown in FIG. 5(*b*) is provided with three engagement means 26, which as mentioned above is more preferable than the two engagement means shown in FIG. 5(*a*). A track is provided in the housing 24 for making passage of the engagement means 26 past the drive connection possible.

Figure 6:
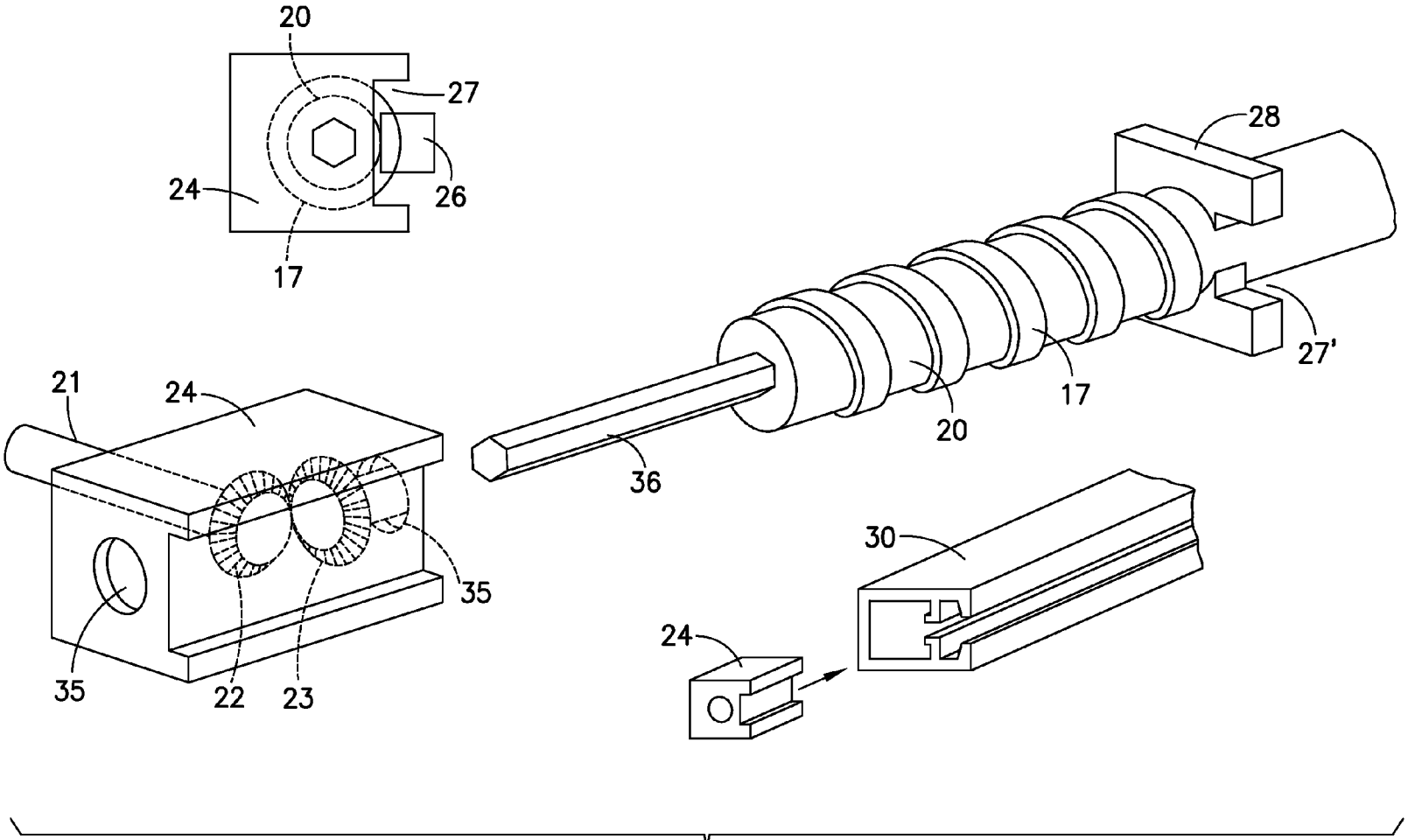
FIG. 6 is a schematic representation of angular gear mechanism and spindle bearings according to an embodiment of the invention.

With reference to FIG. 6 there is shown a schematic representation of a preferred embodiment of an angular gear mechanism and spindle bearings according to the invention. The housing 24 comprises openings 35 for the passage of spindle shaft portions 36 through the openings 35 and engagingly through the gear wheel 23 that is en driving engagement with the gear wheel 22 that is—or can be brought into—connection with the drive shaft 8 of a drive motor. FIG. 6 clearly shows the track 27 provided in the housing 24 for making passage of engagement means of a carriage past the gear mechanism possible. FIG. 6 also shows a bearing 28 for the spindle, which bearing is also provided with a track 27' through which the engagement means can pass in the longitudinal direction of the spindle.

It is understood that although the angular gear mechanisms shown and described throughout the detailed description of the invention are designed for a drive shaft extending substantially perpendicularly relative to the longitudinal axis through the spindle, other angles between the drive shaft and the spindle could also be used depending on the circumstances and that even a parallel extension of the drive shaft with the spindle would be possible within the scope of the present invention.

Figure 7:
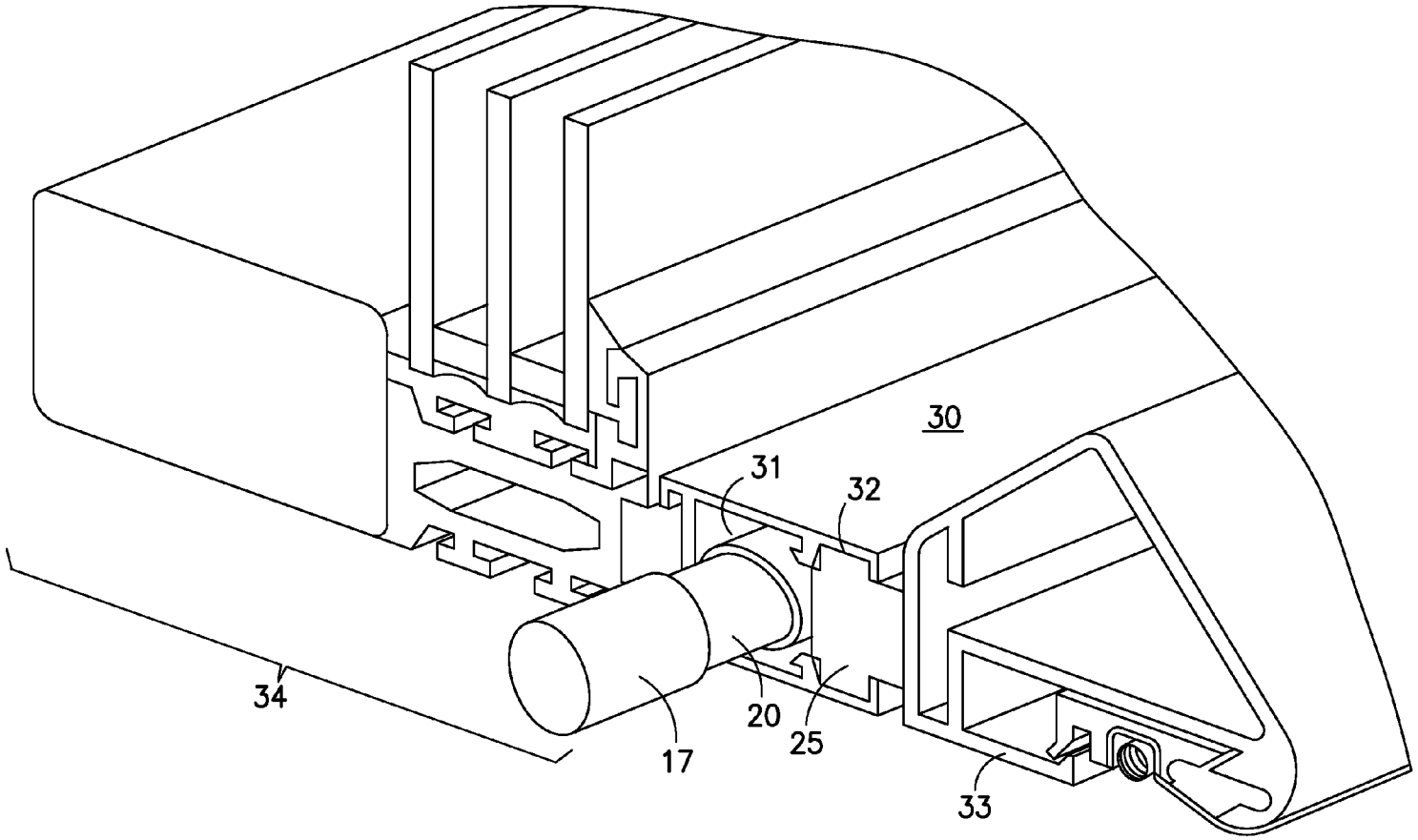
FIG. 7 is a schematic perspective view of the connection between a window section in a building and the frame of a covering showing a drive profile comprising a longitudinal spindle track for accommodating the spindle and an adjacent longitudinal track for the carriage, which carriage is connected to the frame of a covering.

With reference to FIG. 7 there is shown a schematic perspective view of the connection between a window section—generally designated by reference numeral 34—in a building and the frame 33 of a covering. The interconnection between the window portion and the frame of the covering comprises the guide track member 30, for instance formed of an extruded metal or plastics profile, and comprising a longitudinal spindle track 31 for accommodating the spindle and an adjacent longitudinal track 32 for accommodating the carriage 25, which carriage 25 is connected to the frame 33 of a covering.

Figure 8:
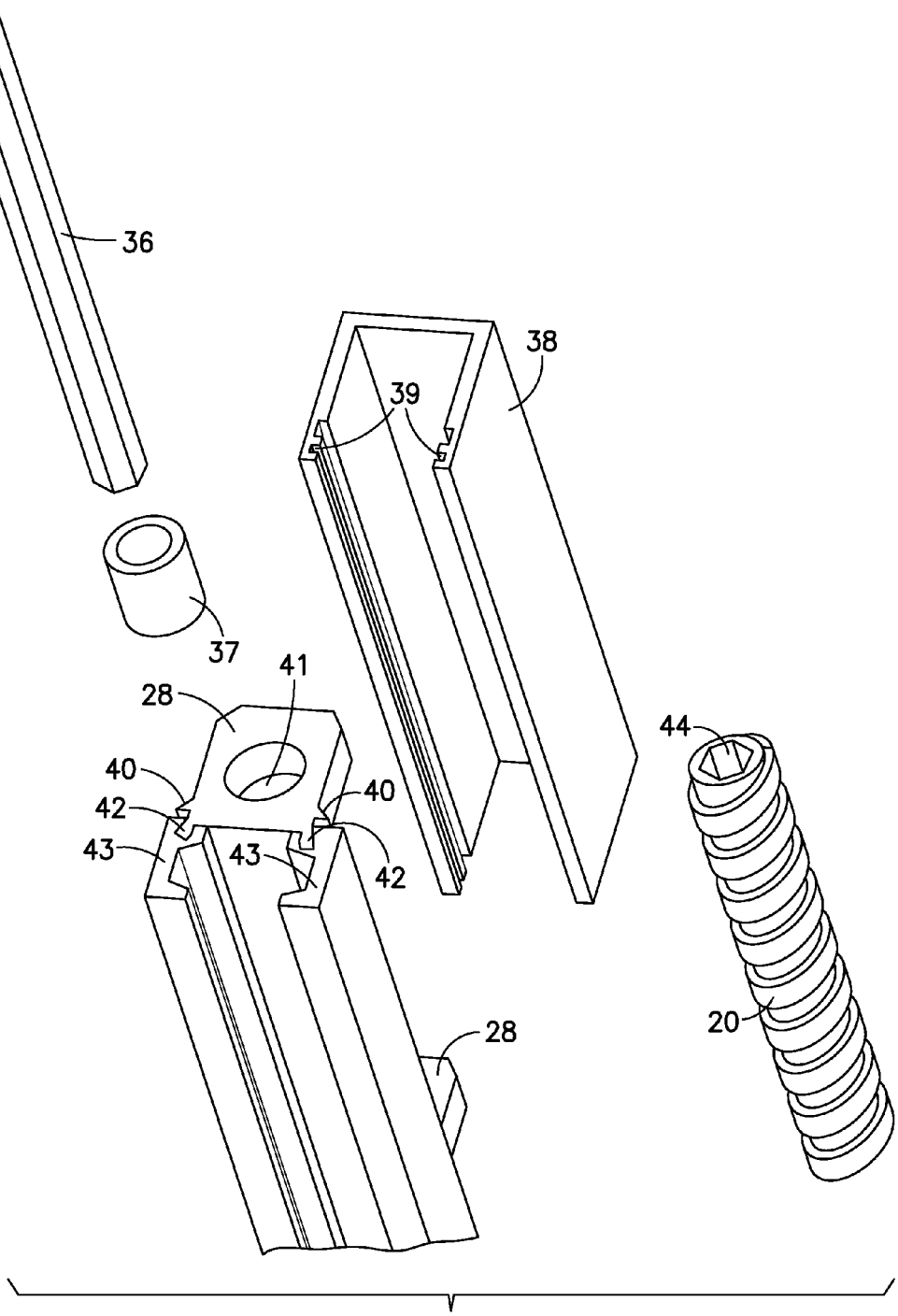
FIG. 8 is a schematic representation of a guide track member and a drive spindle.

FIG. 8 is a schematic representation of a guide track member and a drive spindle. The guide track member comprises a first profile 38, a spindle 20, bearing plates 28, and second profiles 43. The first profile 38 defines a spindle track for accommodating the spindle 20. The first profile 38 is u-shaped and the spindle track has a generally rectangular cross section. The side walls of the profile comprise grooves for receiving coupling members 40 of the bearing plates 28.

The spindle 20 is a tubular member having a central tube 44 for receiving a drive shaft 36 for driving the spindle.

The bearing plates 28 have a central hole 41 for receiving a bushing 37 through which the shaft 36 may extend. The bearing plate has a circumferential shape that matches the interior circumferential shape of the profile 38. The bearing plate further has coupling members 40 configured to engage the grooves 39 of the profile 38 when the bearing plate is inserted into the spindle track.

Each bearing plate 28 further comprises coupling members 42 for connecting the bearing plate to profiles 43, e.g. in a snap-op fashion such that the profiles 43 together define a guide track for the carriage of a covering.

The drive system may thus be assembled by attaching the bearing plates 28 to the profiles 43, inserting the bushings 37 in the holes 41 of the bearing plates, positioning the drive shaft sections 20 between adjacent bearing plates such that the central tube 44 of the drive shaft is aligned with the holes 41 of the bearing plates, and advancing the drive shaft 36 through the bushings 37 and the inner tube 44 of the spindle sections 20. The resulting assembly may then be connected with the profile 38 by laterally inserting the spindle 20 and bearing plates 28 into the spindle track until the coupling elements 40 engage the grooves 39.

Figure 9A:
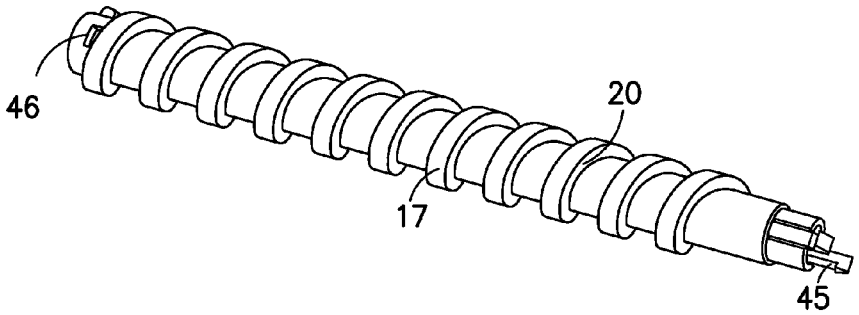
FIG. 9 shows an example of a drive spindle comprising multiple spindle sections.

FIG. 9 shows an example of a drive spindle comprising multiple spindle sections. In particular, FIG. 9*a* shows a spindle section 20 configured to be connected with other, like spindle sections so as to assemble a longer spindle made up of two or more such spindle sections. To this end, the spindle section 20 comprises respective coupling members 45 and 46 at its respective longitudinal ends. The coupling members are configured to engage in a mating connection with corresponding coupling members on another, like spindle section, e.g. in a resilient snap-on fashion. In the example of FIG. 9*a*, the spindle section comprises a male coupling member 45 at one end and a female coupling member 46 at the other end. The coupling members are arranged such that the spindle sections can only be coupled to each other in a predetermined angular relationship so as to cause the combined spindle to have continuous helical thread 17.

Figure 9B:
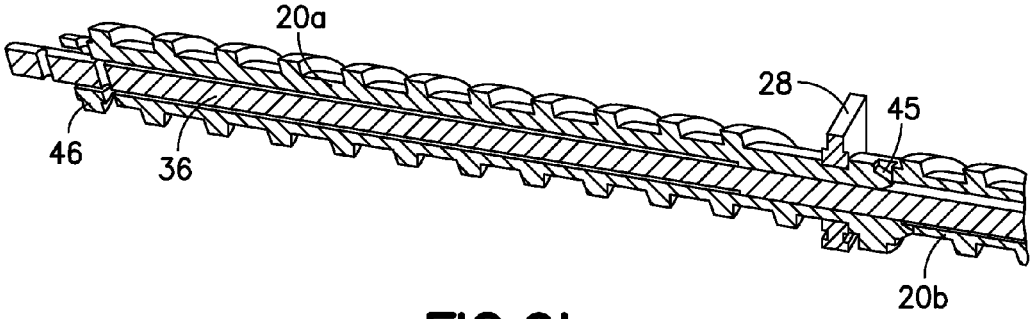

FIG. 9*b* shows in a partly sectional view of two spindle sections 20*a-b* connected to each other. At the connection the helical thread leaves a circumferentially extending gap for accommodating a bearing plate 28. Hence, a male coupling member 45 of one spindle section 20*a* may be inserted into the hole of the bearing plate 28, and the female coupling member of the other spindle section 20*b* may be connected to the coupling member 45 protruding through the hole of the bearing plate. As described above, the spindle sections have a central tube through which a drive shaft 36 may extend.

Figure 10:
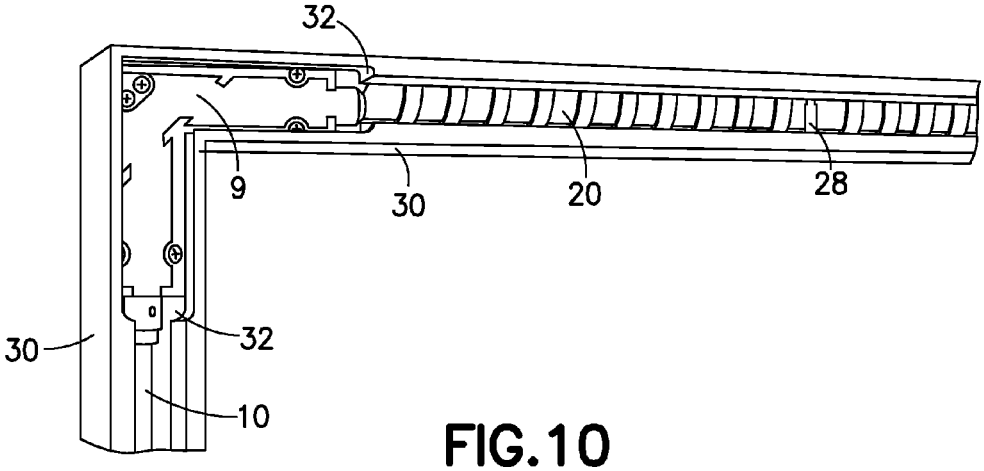
FIG. 10 shows components of an example of a drive system.

FIG. 10 shows components of an example of a drive system. In particular, FIG. 10 shows a support frame whose frame members/legs are formed by guide track members 30. The guide track members comprise a spindle track for receiving either a spindle 20 or an interconnecting drive shaft 10 for connecting drive spindle 20 with a motor and/or another drive spindle. The guide tack members 30 further comprise an adjacent guide track 32 for receiving a carriage (not shown) of a covering or for receiving an attachment part of a sealing member (not shown). The drive spindle 20 may be of the type shown in FIG. 9 comprising a plurality of spindle sections and supported by bearing plates 28 and a central drive shaft. The drive system of FIG. 10 comprises a spindle extending in frame member of the support frame and an interconnecting shaft 10 extending in the adjoining frame member. The drive spindle and the interconnecting shaft 10 are coupled to each other by an angular gear mechanism 9 which is also accommodated in the spindle track of the support frame and located in a corner of the support frame.

FIG. 11 shows an example of a covering system. In particular, FIGS. 11*a*-11*b* show a sectional view of a covering system for a window of a building. The covering system comprises a support frame whose frame members are formed by guide track members 30 for supporting and driving a covering. The system further comprises a covering comprising a slidable frame 33 and a cover member 53. In the example of FIGS. 11*a-b*, the guide track member 30 is mounted to the window frame 54 of a window. The window further comprises a sash 55 and a window pane 56.

The guide track member 30 comprises a spindle track 31 and an adjacent guide track 32, e.g. as described in connection with FIGS. 7-10.

Figure 11B:
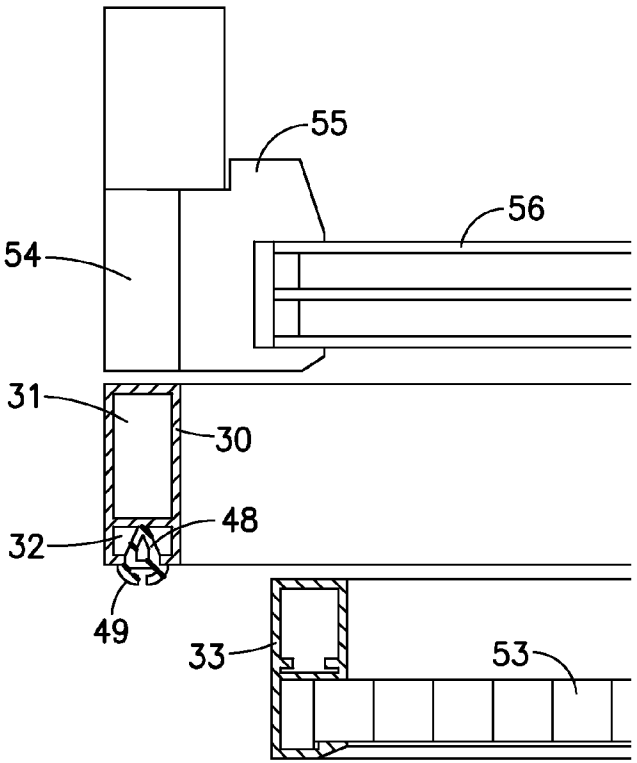
FIG. 11 shows an example of a covering system.
Figure 11A:
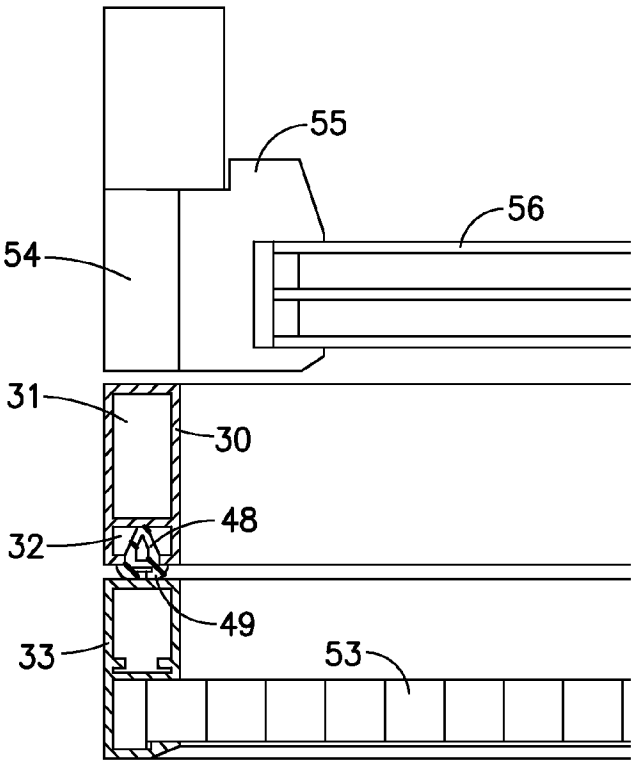

FIG. 11*a* shows the covering in closed position covering the window and where the slidable frame 33 is positioned in front of the support frame 30, while FIG. 11*b* shows the covering in a partly open position where the slidable frame 33 has been slid away sideways from the support frame 30 so as to partly expose the window. Hence, FIGS. 11*a-b* show cross sections of those frame members of the slidable frame 33 that do not comprise a carriage engaging a drive spindle in the spindle track. Instead, a sealing member 48 is inserted in the guide track 32 of the support frame member 30 as indicted by a circle in FIGS. 11*a-b* providing a weather seal between the support frame and the slidable frame, when the covering is in a closed position.

The seal 49 may be a seal strip or gasket, e.g. made from rubber or another suitable material, having a sealing part 49. In the example of FIGS. 11-*a-b*, the sealing part 49 is in the form of a collapsible, hollow structure which can be compressed to a collapsed state when the slidable frame is in its closed position in front of the support frame, as shown in FIG. 11*a*. When the slidable frame 33 is moved away from the support frame member 30, the hollow sealing part 49 returns to an uncollapsed configuration, as shown in FIG. 11*b*. However, other forms of sealing members such as brush seals may be used instead.

Figure 11E:
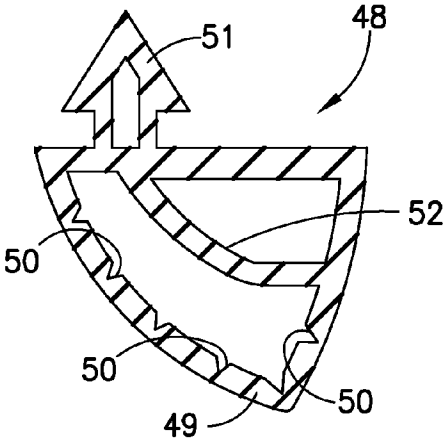
Figure 11F:
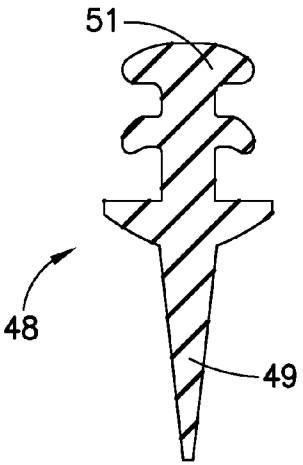
Figure 11D:
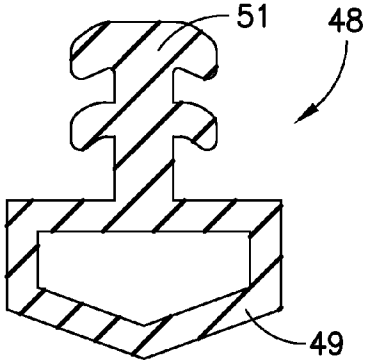
Figure 11C:
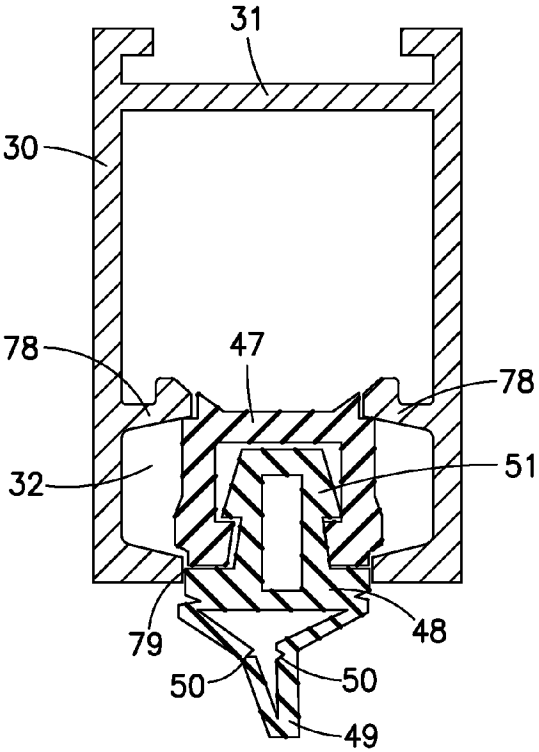

FIG. 11*c* shows a more detailed sectional view of a guide track member 30 of the support frame with a sealing strip inserted in the guide track 32. The guide track member comprises a longitudinally extending spindle track 31 and adjacent, longitudinally extending guide track 32. The two tracks are separated by a partial dividing wall which leaves a longitudinally extending aperture or slit between the tracks allowing engagement members of a carriage that moves in the guide track 32 to engage a spindle located in the spindle track 31. The guide track 32 also has a longitudinally extending aperture 79 facing the slidable frame (not shown) allowing a carriage in the guide track 32 to be connected to a slidable frame.

In the example of FIG. 11*c*, a generally u-shaped profile 47, e.g. made of plastic, is initially inserted into and fastened inside the guide track 32, e.g. by a resilient snap-in mechanism. The profile 47 is inserted with its open end facing the lateral aperture 79 of the guide track 32 so as to provide a receiving channel of suitable size and shape for a sealing member 48.

The sealing member is a strip seal having an attachment part 51 and a sealing part 49. The attachment part is configured for insertion into the receiving channel of the profile 47 and for fastening therein, e.g. by frictional or resilient engagement with the interior circumference of the receiving channel of the profile 47. The sealing part 49 extends out of the receiving channel towards a slidable frame (not shown). In the example of FIG. 11*c*, the sealing part 49 is a hollow structure having a generally triangular cross section, but where the exposed sides of the triangle have longitudinal folding lines 50 (e.g. longitudinally extending grooves) that facilitate collapsing or folding of the sealing part 49 upon exposure to pressure from a slidable frame being moved into a position in front of the guide track.

It will be appreciated that the seal member 48 and the profile 47 may alternatively be provided as a single element such that the sealing member may be inserted directly into the guide track 32.

FIGS. 11*d-f* illustrate different examples of sealing members 48 comprising respective attachment parts 51 and sealing parts 49. The sealing members of FIGS. 11*d* and *e* are similar to the sealing member of FIG. 11*c* in that their sealing parts 49 are hollow structures defined by relatively thin side walls. The sealing part 49 of FIG. 11*d* has a symmetric cross section while the sealing part 49 of FIG. 5*e* has an asymmetric cross section. Furthermore, the sealing part 49 of FIG. 11*e* has an additional internal support wall 52 connecting a base wall of the hollow structure and one of its side walls. The side walls of the sealing part 49 of FIG. 11*e*, and optionally the support wall 52, are also provided with folding lines 50 as described above.

The sealing part 49 of the sealing member 48 shown in FIG. 11*f* has a blade-like shape.

Figure 12:
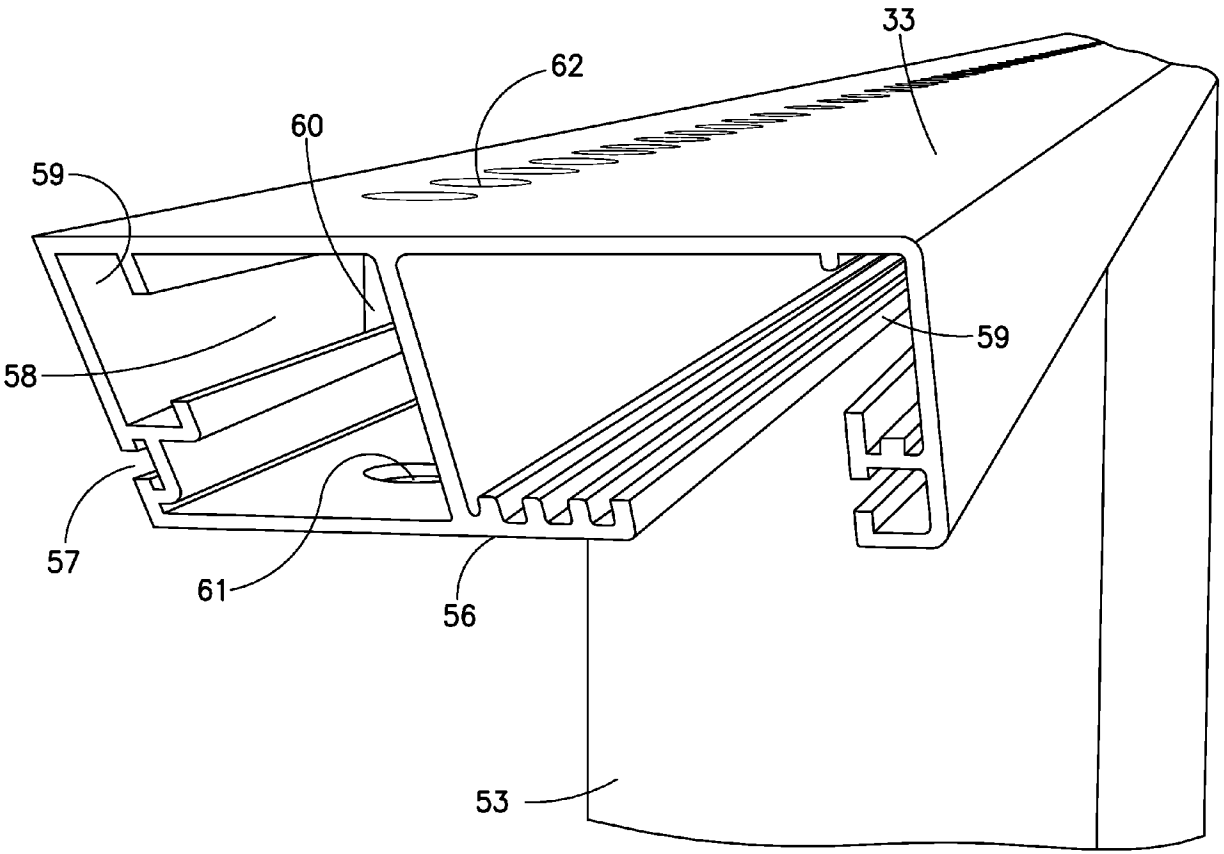
FIG. 12 shows an example of a covering.

FIG. 12 shows an example of a slidable frame 33 and cover member 53 of a covering. The frame 33 is made from extruded profiles forming at least two channels 59. A receiving channel 56 provides a lateral receiving slit for receiving the edges of the cover member 53, e.g. a pane of suitable material or a sheet material mounted on a frame. A ventilation channel 58 is located adjacent to and on the mounting side of the receiving channel 56, i.e. closer to support frame to which the slidable covering is to be mounted. The outer and inner side walls of the ventilation channel are provided with ventilation holes 60 and 61, respectively so as to provide a ventilation path between the exterior of the covering and the space between the covering and the surface covered by the covering. Generally, it will be appreciated that the covering may comprise a mechanism for opening and closing the ventialation hols 60 and/or 61 or otherwise selectively blocking the ventilation path so as to control the ventilation manually and/or automatically. As will be described in greater detail below, the ventilation holes may be provided on some or all sides of the frame 33. In some embodiments they are provided only in the upper and/or lower horizontal members of the frame.

The frame 33 further comprises mounting means 62 for attaching a carriage to the frame 33. In the example of FIG. 12, the mounting means 62 is formed as a lateral aperture facing the support frame and into which a mounting part of the carriage may be inserted and secured, e.g. by screws, e.g. extending through the upper and/or lower walls of the profile.

The frame further comprises a receiving channel 57 facing the support frame for receiving a seal strip, e.g. a brush seal.

Figure 13A:
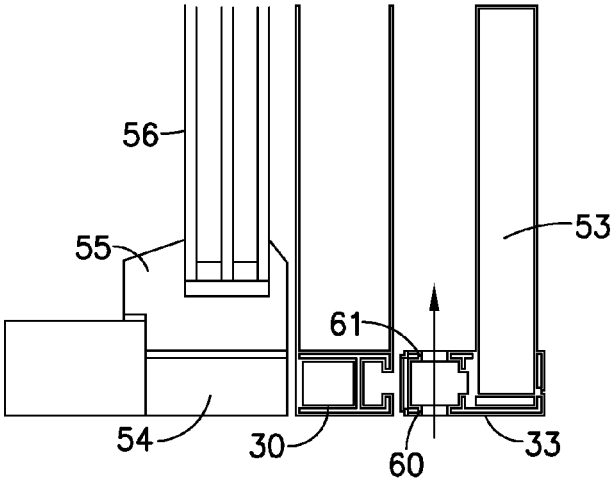
FIGS. 13-15 show examples of covering systems with ventilation channels.
Figure 13B:
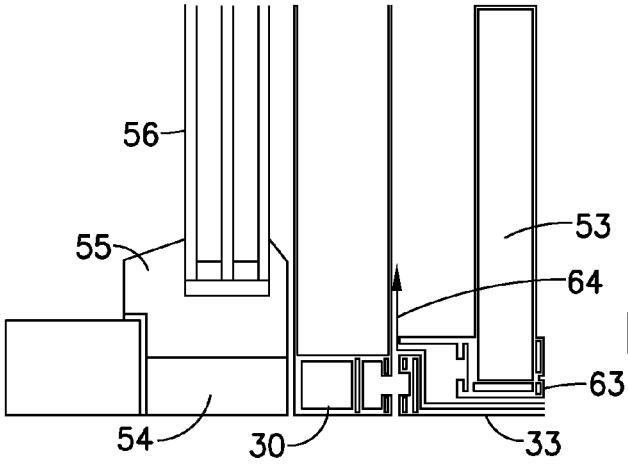
Figure 13C:
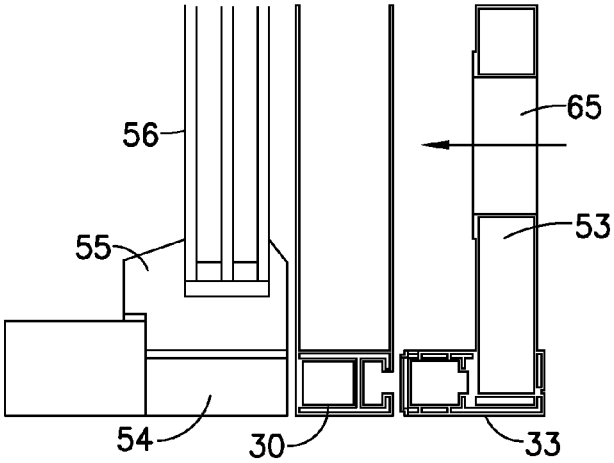

FIG. 13 shows further examples of a covering system. Each of FIGS. 13*a-c* shows a covering system similar to the system of FIG. 11*a*. The system comprises a covering and a support frame 30 for supporting and driving the covering. The covering comprises a slidable frame 33 and a cover member 53. The covering system is mounted to a window frame 54 of a window of a building, the window comprising the frame 54, a sash 55 and a window pane 56. FIGS. 13*a-c* illustrate different embodiments of ventilation channels.

In the embodiments of FIGS. 13*a-b*, a ventilation channel is integrated in the slidable frame 33, e.g. the lower and/or upper horizontal frame member, while in the embodiment of FIG. 13*c*, the ventilation channel 65 is provided in the cover member 53.

In the example of FIG. 13*a*, the inward portion of the frame member 33 comprises a number of holes 60 and 61. In the example of FIG. 13*b*, the bottom member of the frame is formed by two separate profiles that leave a ventilation channel between them. The ventilation channel has an exterior inlet 63 and an outlet 64 proximal to the support frame.

FIGS. 14-15 show examples of covering systems with ventilation channels allowing ventilation of the interior of the building even with the covering closed. Each of FIGS. 14*a-e* and FIGS. 15*a-d* shows a covering system similar to the system of FIG. 11*a*, comprising a support frame (not explicitly shown) and a covering including a slidable frame 33 and a cover member 53. The covering system is mounted to a window frame 54 of a window of a building, the window comprising the frame 54, a sash 55 and a window pane 56. The window is mounted in an exterior wall 67 of a building.

Figure 14E:
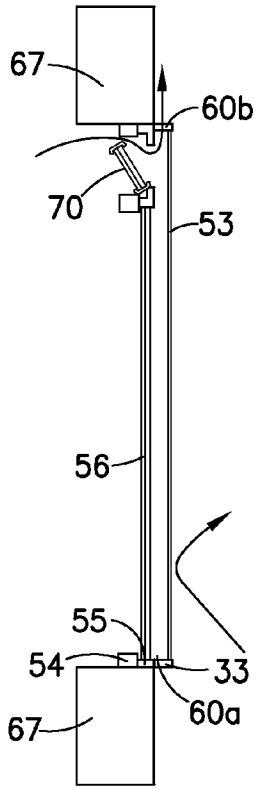
Figure 14D:
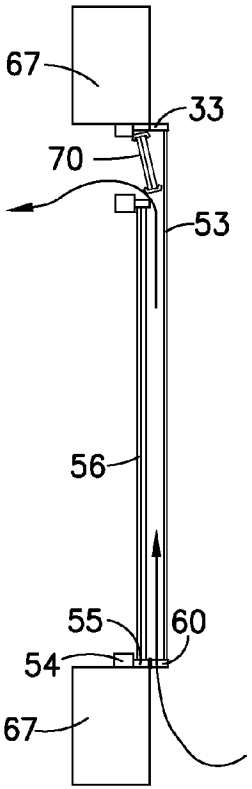
Figure 14C:
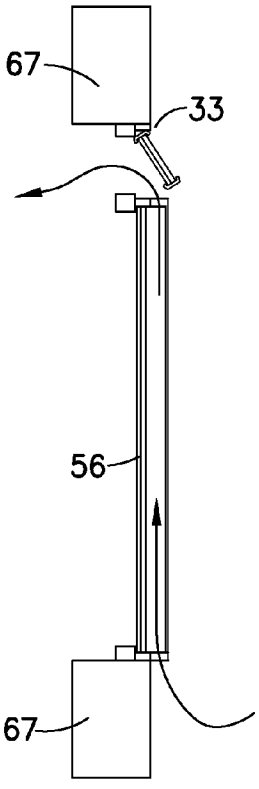
Figure 14B:
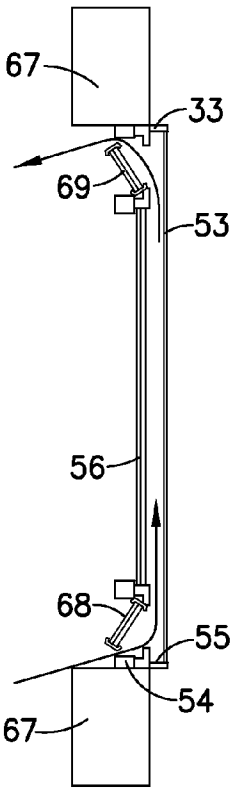
Figure 14A:
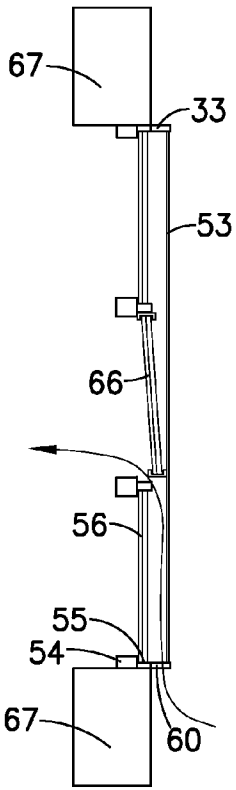

In the example of FIG. 14*a*, the slidable frame 33 comprises a ventilation channel 60 in the lower frame member of the frame 33, and the slidable frame and/or support frame of the covering system is sufficiently wide so as to allow at least a part of the window 66 to be opened when the covering is closed. Hence, fresh air can enter the building through the ventilation channel 60 in the frame 33 and the open window 66.

In the example of FIG. 14*b*, the window comprises lower and upper ventilation openings 68 and 69, respectively. Allowing air from the interior of the building to enter the space between the covering and the window though the lower opening 68 and to re-enter the interior of the building through the upper opening 69, thus allowing utilisation of the thermal convection in the space between window and covering so as to utilise heat created by sunlight irradiating on the covering.

FIGS. 14*c-e* illustrate how ventilation openings 70 at the top of a window can be combined with ventilation channels 60*a*, 60*b* in the bottom and/or upper frame members of the slidable frame 33 so as to provide selective ventilation, e.g. to allow fresh air to enter through ventilation channels 60*a* at the bottom of the slidable frame, provide heating of the air in the space between window and covering, and to allow the heated air to enter the building through an opening 70 at the top of the window e.g. in the form of a small extra window. This opening 70 may be arranged inside the covering as in FIG. 14*d*) or outside the covering (as in FIG. 14*c*). By selectively opening or closing the ventilation channels 60*a* and 60*b* such a system may also be used to allow warm air to exit the building through an upper ventilation opening 70 of the window and ventilation channels 60*b* in the upper part of frame 33, e.g. as illustrated in FIG. 14*e*.

Figure 15D:
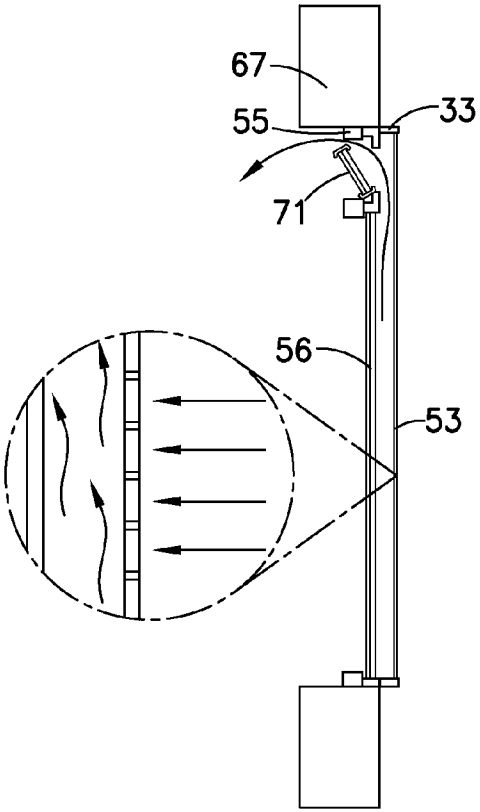
Figure 15C:
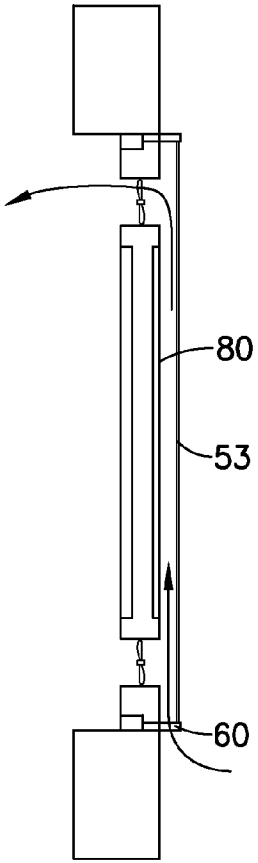
Figure 15A:
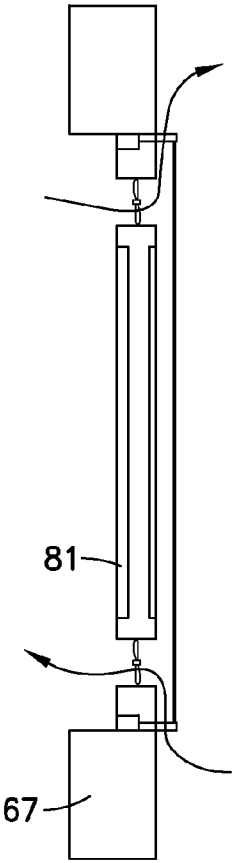
Figure 15A:
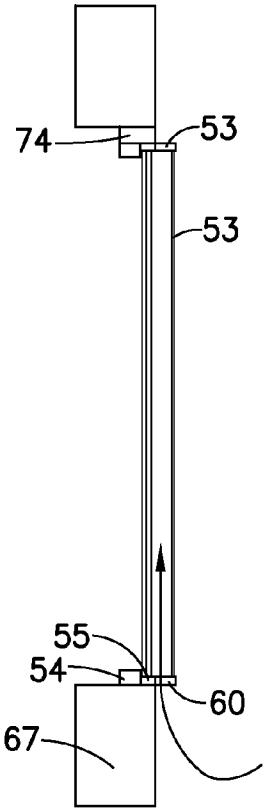

FIG. 15*a* shows another example similar to the one of FIG. 14*c*, but where the ventilation opening of the window is provided as a separate channel 74 above the frame 54.

FIGS. 15*b-c* show an example of the covering system where the window comprises one or more ventilation channels including a ventilation fan 75, 76 respectively. This facilitates a more efficient ventilation and a flexible and selective control of the ventilation, e.g. as regards the direction of the air stream. Electrical power for driving the fans may be generated by solar panels 80 on the exterior surface of the window or building Such solar panels may further be configured to charge a rechargeable battery so as to allow operation of the ventilation fans in the absence of sunlight. In yet further embodiments, the electrical power of the solar panels may be used for interior illumination 81.

The example of FIG. 15*d* is similar to the one of FIG. 14*d* but where the air enters the space between the covering and the window through holes in the cover member 53.

Figure 16:
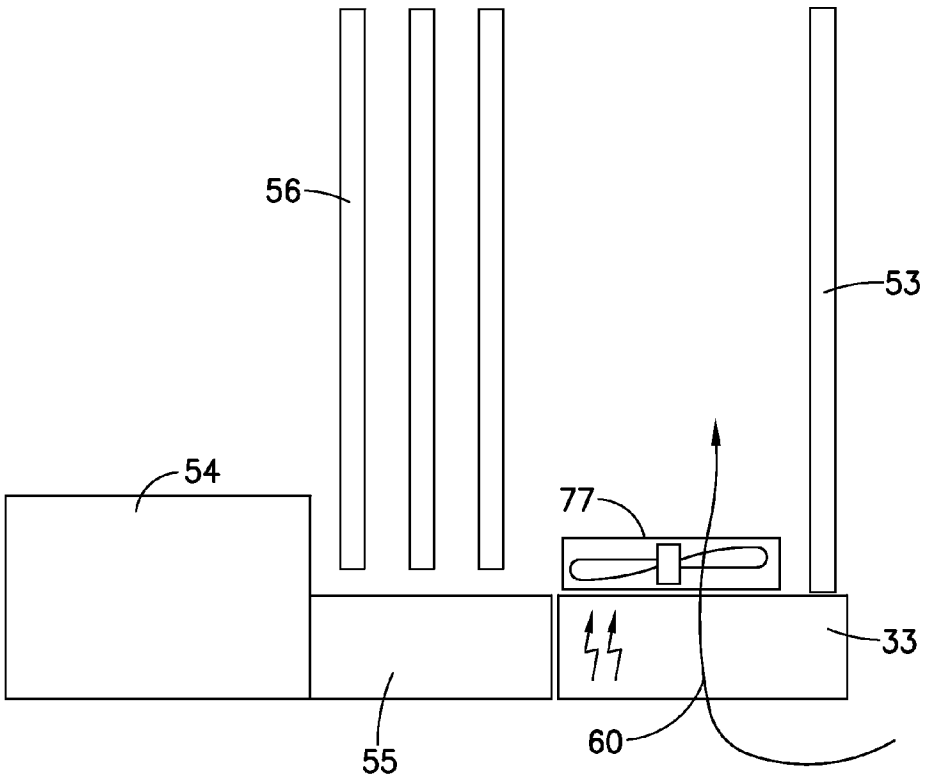
FIG. 16 shows an example of a covering system with a ventilation channel comprising a turbine.

FIG. 16 shows an example of a covering system with a ventilation channel comprising a turbine. In the example of FIG. 16, the bottom frame member of the covering comprises ventilation channels in which a turbine is inserted such that the ventilation stream passes through and drives the turbine 77 so as to allow generation of electrical power. The ventilation stream and thus the power generation is facilitated due to convection in the space between the window pane 56 or other surface of the building and the cover member 53 due to heat generated by sunlight. It will be appreciated that this effect may be increased by suitable choice of materials and colors of the cover member and of the surface covered by the covering. It will further be appreciated that the turbine mat be located at an upper frame member or other suitable position in the ventilation stream.

The invention claimed is:

1. A drive system for displacing a position of a covering disposed over a surface portion of a building, the drive system comprising:

a mechanism for converting a rotary motion originating from a rotary energy generator into a longitudinal motion of at least one carriage that is adapted for attachment to the covering, such that said rotary motion will result in a longitudinal displacement of the covering, the mechanism comprising a plurality of spindle sections drivingly connected at a longitudinal end of at least one of said spindle sections to said rotary energy generator, the system comprising connection means for operatively connecting two spindle sections in longitudinal extension from each other so as to provide a combined drive spindle of extended length; and a guide track member for insertion between the surface portion of the building and the covering, the guide track member being provided with the spindle track for accommodating the drive spindle and an adjacent guide track for accommodating the at least one carriage, wherein the guide track member is attachable to said surface portion and the covering is attachable to said at least one carriage that is displaceable accommodated in the adjacent guide track;

wherein the drive system further comprises one or more bearing members distributed spaced apart from each other along the length of the drive spindle at intervals corresponding to the length of the spindle sections, such that the bearing members are arranged at positions where two spindle sections are connected to each other, and wherein the bearing members are formed as plates having an outer periphery matching the interior circumference of the spindle track and a central through hole through which the drive spindle extends.

2. A drive system according to claim 1, wherein said at least one carriage is guided for longitudinal movement along said one or more spindle sections, the at least one carriage being provided with engagement members formed for engagement with threads of the spindle sections, such that a rotation of the spindle sections will result in a longitudinal displacement of the at least one carriage along the spindle sections.

3. A drive system according to claim 2, wherein at least two engagement means are spaced apart in the longitudinal direction further than the longitudinal extent of the housing of the gear mechanism.

4. A drive system according to claim 1, wherein the longitudinal end of the at least one of said spindle sections is drivingly connected to said rotary energy generator via a gear means.

5. A drive system according to claim 4, wherein said gear means is an angular gear means converting a rotational movement of a drive shaft having a first longitudinal axis X1 into a rotational movement of a second shaft having a second longitudinal axis X2, where the axis X1 and X2 form an angle between each other.

6. A drive system according to claim 5, wherein said angle is substantially 90 degrees.

7. A drive system according to claim 4, wherein said gear means comprises a housing accommodating a first gear wheel for connection to a drive axle of said rotary energy generator and a second gear wheel in engagement with the first gear wheel, the second gear wheel being adapted for connection to a longitudinal end of a spindle section.

8. A drive system according to claim 4, wherein the gear means is enclosed within a housing, and where the housing is provided with a track through which the engagement means can pass in the longitudinal direction of the spindle.

9. A drive system according to claim 1, wherein the system comprises a first drive spindle comprising one or more spindle sections, and a second drive spindle comprising one or more spindle sections, where the first and second drive spindles are drivingly connected via an interconnecting shaft connected to corresponding longitudinal ends of said first and second drive spindles via an angular gear mechanism.

10. A drive system according to claim 9, wherein said rotary energy generator is drivingly connected to the first or the second drive spindle.

11. A drive system according to claim 10, wherein said rotary energy generator is drivingly connected to the interconnecting shaft.

12. A system comprising:

the drive system according to claim 1; and the covering disposed over the surface portion of the building.

13. A system according to claim 12, wherein the covering comprises a covering frame defining an aperture, wherein a first carriage of said at least one carriage is attached to a first frame member of the covering frame, and wherein the first carriage is operatively engaged with a first drive spindle of said plurality of spindle sections, where the first drive spindle is configured to convert a rotary motion into a longitudinal motion of the first carriage.

14. A system according to claim 13, wherein a second carriage of said at least one carriage is attached to a second frame member of the covering frame, opposite the first frame member relative to the aperture defined by the frame, and wherein the second carriage is operatively engaged with a second drive spindle of said plurality of spindle sections, where the second drive spindle is configured to convert a rotary motion into a longitudinal motion of the second carriage; and wherein the first and second drive spindles are spaced apart by a distance corresponding to a size of the covering frame as defined by the distance between the first and second frame members.

15. A system according to claim 14, wherein the first and second drive spindles are drivingly connected via an interconnecting shaft connected to corresponding longitudinal ends of said first and second drive spindles via an angular gear mechanism.

16. A system according to claim 14, further comprising a support frame for attachment to a surface portion of a building, wherein the support frame comprises a guide track member provided with a spindle track for accommodating the drive spindle and an adjacent track for accommodating the carriage.

17. A system according to claim 16, wherein the support frame comprises a sealing member for sealing an interface between the support frame and the covering frame when the covering is positioned in a position in front of the support frame.

* * * * *